US009314104B2

(12) United States Patent
Stieglitz et al.

(10) Patent No.: US 9,314,104 B2
(45) Date of Patent: Apr. 19, 2016

(54) SLEEP SYSTEM MECHANISM

(75) Inventors: Steven Stieglitz, Harlan, IN (US); Joel Derek Alberda, Leo, IN (US); Martin J. Krause, Fort Wayne, IN (US); Donald E. Newfer, Auburn, IN (US)

(73) Assignee: Sauder Manufacturing Company, Archbold, OH (US)

( * ) Notice: Subject to any disclaimer, the term of this patent is extended or adjusted under 35 U.S.C. 154(b) by 767 days.

(21) Appl. No.: 12/860,246

(22) Filed: Aug. 20, 2010

(65) Prior Publication Data

US 2013/0019400 A1 Jan. 24, 2013

Related U.S. Application Data

(60) Provisional application No. 61/286,285, filed on Dec. 14, 2009.

(51) Int. Cl.
*A47C 17/165* (2006.01)
*A47C 7/50* (2006.01)

(52) U.S. Cl.
CPC ..... *A47C 17/1655* (2013.01); *A47C 7/506* (2013.01)

(58) Field of Classification Search
CPC ..... A47C 17/161; A47C 17/165; A47C 17/1655; A47C 17/1756; A47C 17/62; A47C 7/506
USPC ..... 5/43, 45, 46.1, 47; 297/125, 378.1
See application file for complete search history.

(56) References Cited

U.S. PATENT DOCUMENTS

| | | | | |
|---|---|---|---|---|
| 481,385 | A | 8/1892 | Barger | |
| 2,028,426 | A * | 1/1936 | Wunderlich | 5/47 |
| 2,295,083 | A * | 9/1942 | Jonassen | 5/57.1 |
| 2,330,059 | A * | 9/1943 | Krakauer et al. | 5/47 |
| 2,435,936 | A * | 2/1948 | Wilson | 5/47 |
| 2,437,949 | A * | 3/1948 | Fox et al. | 5/47 |
| 2,634,429 | A * | 4/1953 | Hopeman, Jr. et al. | 5/43 |
| 2,672,626 | A * | 3/1954 | Watt | 5/47 |
| 2,714,729 | A * | 8/1955 | Bohnsack et al. | 5/43 |
| 2,028,105 | A | 3/1960 | Bohnsack | |
| 2,928,105 | A * | 3/1960 | Bohnsack | 5/43 |
| 3,048,855 | A | 8/1962 | Frank | |
| 4,048,680 | A * | 9/1977 | Rogers, Jr. | 5/37.1 |
| 4,104,747 | A * | 8/1978 | Bell et al. | 5/37.1 |
| D321,797 | S | 11/1991 | Paris | |
| D326,367 | S | 5/1992 | Messina | |
| 5,224,228 | A | 7/1993 | Larrimore | |
| 5,621,930 | A | 4/1997 | Reppas | |
| 5,695,239 | A * | 12/1997 | Johnson et al. | 297/69 |
| 6,508,526 | B2 * | 1/2003 | Reppas et al. | 312/237 |
| 6,651,274 | B2 * | 11/2003 | Swihart et al. | 5/47 |
| 6,779,208 | B2 | 8/2004 | Lim | |
| 6,904,628 | B2 | 6/2005 | Murphy | |
| 6,934,979 | B2 | 8/2005 | Swan | |
| D555,383 | S | 11/2007 | Borgonovo | |

(Continued)

*Primary Examiner* — Robert G Santos
*Assistant Examiner* — Myles Throop
(74) *Attorney, Agent, or Firm* — McGarry Bair PC

(57) ABSTRACT

A furniture system (100) is disclosed which is movable between a sofa configuration and a sleep configuration. The system (100) includes a movable high back cushion (124) with a handle (122). Below the high back cushion (120) is an intermediate back cushion (124). A seat cushion (128) is also provided. Linkage mechanisms (134) are coupled to various components of the system (100). The linkage mechanisms (134) facilitate and guide movement of the back cushion assembly (120, 124) between the sofa and sleep configurations.

30 Claims, 19 Drawing Sheets

(56) References Cited

U.S. PATENT DOCUMENTS

| | | | | |
|---|---|---|---|---|
| 7,549,182 | B2 | 6/2009 | Murphy | |
| 7,607,180 | B2 * | 10/2009 | Griepentrog | 5/43 |
| 2004/0195798 | A1 * | 10/2004 | Newfer et al. | 280/250.1 |
| 2005/0267900 | A1 | 12/2005 | Ahmed | |
| 2007/0136952 | A1 | 6/2007 | Sargent | |
| 2008/0148478 | A1 | 6/2008 | Patella | |
| 2008/0189851 | A1 * | 8/2008 | Griepentrog | 5/43 |
| 2012/0131745 | A1 * | 5/2012 | Wieland et al. | 5/2.1 |

* cited by examiner

SLEEP SYSTEM MECHANISM

CROSS-REFERENCE TO RELATED APPLICATIONS

This application is based upon and claims priority of U.S. Provisional Patent Application Ser. No. 61/286,285, filed Dec. 14, 2009.

STATEMENT REGARDING FEDERALLY SPONSORED RESEARCH OR DEVELOPMENT

Not applicable.

REFERENCE TO A MICROFISHE APPENDIX

Not applicable.

BACKGROUND OF THE INVENTION

1. Field of the Invention

The invention relates to furniture systems having the capability of converting between sofa and sleep surface configurations and, more particularly, mechanisms for use with the furniture systems to facilitate conversion, in addition to the use of a "high back" configuration and the addition of extendable/retractable ottoman features.

2. Background Art

Various furniture systems are known in the prior art which include the capability of converting between differing types of furniture configurations. For example, it is known in the art to provide for the capability of converting a furniture system in the form of a sofa to one which provides for a bed or other sleep surface. However, many of the known systems have various disadvantages associated with their conversions between sofa and sleep surface configurations. A number of convertible furniture systems include components which are useful with respect to only one of the configurations. Some of these systems include "fold out" components which provide for bed surfaces when the furniture system is in a sleep surface configuration, but do not require the bed surface component for any useful purpose when the furniture system is in the sofa configuration.

Still further, a number of convertible furniture systems include back supports which are used when the furniture system is in a sofa configuration. However, when the known furniture systems are in a sleep surface configuration, the back support is retained in the same position as in the sofa configuration, and serves no useful purpose in the sleep surface configuration.

Also, it is not uncommon for known systems to require either forward or rearward movement of various furniture components when the known furniture system is moved from a sofa configuration to a sleep configuration. These forward and/or rearward movements can cause space difficulties with respect to placement of the furniture system. For example, forward encroachment of one or more of the furniture system components into a room can result in prevention of the furniture system being placed in a convenient location.

Still further, many of the known convertible furniture systems include relatively complex linkages for movement of various furniture components during conversion. The complexity of these linkages can result in substantial expense and are often relatively more subject to breakdown or damage. In addition, some linkages can present potential safety hazards. More specifically, complex linkages associated with known convertible furniture systems often include dangerous "pinch points" which can exist during linkage movement. Safety hazards associated with such linkage pinch points are exacerbated when the linkages are normally visible and physically accessible to children or others.

As an example of known convertible systems, Murphy, et al, U.S. Pat. No. 6,904,628 generally describes a sofa bed having a frame with opposing arms, and a seat. A subseat is hinged to the seat, and a connecting rod pivotably interconnects the subseat and the backrest. Pairs of center legs and end legs are pivotably attached to the subseat and seat, respectively. Mechanisms are provided for folding and unfolding the center and the end legs. The configuration includes a leg-folding mechanism which is pivotably interconnected with the center and the end legs. The frame, backrest, seat and subseat are configured so that the backrest, seat and subseat move from a folded position to an unfolded position. In the folded position, the backrest is generally upright, the seat is generally horizontal and the subseat is positioned beneath the seat in a first inverted orientation. In the unfolded position, the backrest, subseat and seat are generally horizontal, and the subseat is positioned between the backrest and the seat in a second non-inverted orientation. The leg-folding mechanism includes a center leg mechanism and an end leg mechanism. The center leg is pivotably interconnected with the subseat at a second pivot, with the second pivot being rearward of a first pivot when the sofa bed is in an unfolded position. The center leg mechanism includes a brace which is pivotably connected with the center leg and with the seat. The subseat and the seat are interconnected by means of a hinge. The hinge includes a subseat plate fixed to the subseat. The center leg is pivotably interconnected to the subseat plate at the second pivot.

Patella, U.S. Patent Application Publication No. 2008/0148478 describes a sofa bed having a base structure with a series of mutually hinged frames. The frames are supported by the base structure and support a series of padding elements. A kinematic mechanism is utilized to change the positions of the frames. The base structure includes a set of small legs, a spacer and a hinge plate consisting of two flat surfaces. The hinge plate is fixed on the small leg which consists of two flat surfaces with a rectangular hole. The hole is tapped (i.e. punched out a limited depth with a wider diameter) on one side to lodge the spacer. An assembly procedure removes the clearance in the coupling between the hinge and the spacer, and obtains a perpendicular configuration between the spacer and the small leg.

Murphy, U.S. Pat. No. 7,549,182 discloses a seating unit having a frame and backrest section, with the backrest section having a cushion. Body, hinge and foot sections share a common cushion, and a folding mechanism includes a series of pivotably interconnected links which are configured so as to move the backrest, body, hinge and foot sections between folded and unfolded positions. In the unfolded position, the backrest, body, hinge and foot sections are horizontally disposed and serially aligned. The backrest cushion and the common cushion face upwardly. In the folded position, the backrest section is upright, with the backrest cushion facing forwardly. The body section is horizontally disposed, and the foot section overlies the body section. The hinge section is vertically disposed and extends between the body and foot sections. The common cushion is folded upon itself. A portion of the common cushion overlying the body section and a portion of the common cushion underlying the foot section are compressed against each other. In addition, the body, hinge and foot sections each include a panel. A fixed support hinge includes a flexible sheet member which is fixed to the body and hinge section panels. A second support hinge which includes a flexible sheet member is fixed to the hinge and foot section panels.

SUMMARY OF THE INVENTION

In accordance with the invention, a sleep system assembly is adapted for conversion between a sofa configuration where a user may sit on the assembly in a substantially upright position, and a sleep configuration where the user may lie in a substantially prone position. The assembly includes a supporting frame and a seat having an upper surface on which the user may sit when the assembly is in the sofa configuration. A back cushion assembly is also included, having a frontal region for supporting the user's back when the assembly is in the sofa configuration. At least one linkage mechanism is provided, with the linkage mechanism being directly or indirectly connected to the frame, and coupled to the back cushion assembly. The linkage mechanism includes a series of interconnected links. In response to external forces applied by the user to the sleep system assembly, the linkage mechanism will guide movement of the back cushion assembly between the sofa configuration and the sleep configuration. When the sleep system assembly is in the sleep configuration, a sleep surface is formed by rear surface regions of the back cushion assembly.

The linkage mechanism can include a mechanism base plate connected to the frame. A primary mechanism lever can be pivotably coupled to the base plate, and a secondary mechanism lever directly or indirectly coupled to the primary mechanism lever. When the sleep system assembly is in the sleep configuration, support of the sleep surface is provided at least in part by the secondary mechanism lever being oriented beyond center. Further, downwardly directed forces which are exerted on portions of the back cushion assembly which overhang the seat when the sleep system assembly is in the sleep configuration are translated to a mechanism stop through the primary mechanism lever and coupling to the secondary mechanism lever.

In accordance with other aspects of the invention, the frame includes a pair of opposing lateral sides. The linkage mechanism is confined within the lateral sides, so as to be physically inaccessible to the user, in the absence of disassembly of one or more of the sides. Still further, the linkage mechanism is configured and connected to other components of the sleep system assembly so that when the user applies external forces to the assembly so as to move the back cushion assembly between the sofa configuration and the sleep configuration, the user requires only a single, continuous path of motion of a location point at which the user applies the external forces to the sleep system assembly. In accordance with another aspect of the invention, the lateral sides of the frame are constructed so as to be capable of disassembly, so as to facilitate maintenance of the linkage mechanisms.

Still further, the primary mechanism lever and the secondary mechanism lever are configured so as to govern a path and rotational arc of the back cushion assembly during conversion of the sleep system assembly between the sofa configuration and the sleep system configuration. The sleep system assembly also includes a stationary back located behind the back cushion assembly when the sleep system assembly is in the sofa configuration. The linkage mechanism provides for clearance of the back cushion assembly relative to the seat and to the stationary back, when the sleep system assembly is being moved by the user between the sofa configuration and the sleep configuration.

In accordance with other aspects of the invention, none of the series of interconnected links are connected at any single point to more than one other of the interconnected links. The sleep system assembly also includes a mechanism control link connecting the secondary mechanism lever to the primary mechanism lever. The linkage mechanism also includes a mechanism drive shaft extending in a perpendicular orientation relative to a general vertical plane of the linkage mechanism. One end of the mechanism drive shaft is secured to an angled section of the mechanism control link. The sleep system assembly also includes a mechanism connection plate secured to an outer surface of the mechanism drive shaft. The mechanism connection plate provides connection between moving components of the linkage mechanism and the back cushion assembly.

The back cushion assembly includes a first back cushion. The mechanism control link is locked into position relative to the first back cushion, so that a relative orientation of the mechanism control link and the first back cushion remains substantially the same during movement of the first back cushion between the sofa configuration and the sleep configuration. The secondary mechanism lever is pivotably linked to the mechanism control link at a first hinge point. Further, the mechanism control link consists of an angled configuration.

The series of interconnected links includes a mechanism base plate connected to the frame. The mechanism base plate remains stationary during movement of the sleep system assembly between the sofa configuration and the sleep configuration. The mechanism base plate is connected to an inner portion of a corresponding side of the sleep system assembly. The connection of the mechanism base plate to the corresponding side of the sleep system assembly occurs at a series of frame connection points. One of the frame connection points also acts as a stop for a secondary mechanism lever, when the linkage mechanism moves the sleep system assembly from the sofa configuration to the sleep configuration.

The mechanism base plate is connected to the frame at a series of frame connection points. The linkage mechanism includes a series of spacers located at the frame connection points, so as to cause the mechanism base plate link to be displaced or stand away from the corresponding side by a predetermined distance.

The linkage mechanism and other components of the sleep system assembly are structured so that when the assembly is being moved by the user from the sofa configuration to the sleep configuration, there is no forward movement of any components of the assembly, except for links of the series of interconnected links, and the back cushion assembly. When the sleep system assembly is configured in the sleep configuration, the floor space footprint of the sleep system assembly is no larger in area than the floor space footprint of the sleep system assembly when the assembly is in the sofa configuration.

In accordance with other concepts of the invention, the linkage mechanism can be characterized as having a mechanism base plate connected to stationary components of the sleep system assembly. A primary mechanism lever is pivotably coupled at one end to the mechanism base plate at a first hinge point. A secondary mechanism lever is configured so that the primary mechanism lever and the secondary mechanism lever control a rotational arc of the back cushion assembly as the back cushion assembly moves between the sofa configuration and the sleep configuration. A mechanism control link connects the secondary mechanism lever to the primary mechanism lever. The primary mechanism lever is directly connected to the mechanism control link at a second hinge point. The primary mechanism lever links the second hinge point to stationary components of the sleep system assembly through the mechanism base plate. The seat can remain stationary during movement of the sleep system assembly between the sofa and sleep configurations.

In accordance with other concepts associated with the invention, the frame can include a pair of opposing sides having inner portions associated therewith. The inner portions of the sides can include cut-out portions in the form of curvilinear clearance slots. The clearance slots provide minimum clearance to prevent tampering. The slots also provide sufficient clearance for other components of the sleep system assembly so as to avoid the occurrence of any pinch points associated with the assembly.

The back cushion assembly can include a first back cushion. Also included is a second back cushion extending upwardly from a top portion of the first back cushion. The second back cushion can be configured so as to facilitate seated user comfort, and extend the sleep surface when the sleep system assembly is in the sleep configuration. The assembly can include a high back stationary support, with the high back stationary support being positioned behind and adjacent to a rear portion of the second back cushion, when the sleep system assembly is in the sofa configuration. The high back stationary support remains in a fixed position during movement of the assembly between the sofa configuration and the sleep configuration.

The assembly also includes a hinge located between a top of the first back cushion and a lower portion of the second back cushion. The hinge is structured so as to permit articulation between the first and second back cushions. The hinge is also structured so as to permit rear portions of the first and the second back cushions to be positioned in substantially a single horizontal plane, when the first and second back cushions are in the sleep configuration. In accordance with certain aspects of the invention, the hinge can include a fabric hinge. A gap or space of the fabric hinge can move toward an open orientation as the sleep system assembly moves toward the sleep configuration. The back cushion assembly, stationary back and seat can be sized and configured so as to provide for the formation of clean out areas between the components of the sleep system assembly.

In accordance with various other aspects of the invention, the sleep system assembly can include a pair of linkage mechanisms. One of each of the pair of linkage mechanisms is associated with a corresponding one of a pair of opposing sides of the sleep system assembly.

Still further, in response to external forces applied by the user to the sleep system assembly, the linkage mechanism will guide movement of the back cushion assembly between the sofa configuration and the sleep configuration. Further, the sleep system assembly includes an ottoman assembly comprising one or more ottomans extending forwardly from front portions of the assembly. At least one of the ottomans can be mechanically movable by the user between an extended position, where the ottoman is positioned forwardly of the front portions of the sleep system assembly, and a retracted position where the ottoman is positioned inwardly from the front portion and below the seat. In accordance with another concept of the invention, the sleep system assembly can include at least one drawer assembly positioned below the seat and extendable by the user between an open, extended position and a closed, retracted position.

BRIEF DESCRIPTION OF THE SEVERAL VIEWS OF THE DRAWING

The invention will now be described with reference to the drawings, in which.

DETAILED DESCRIPTION OF THE INVENTION

The principles of the invention are disclosed, by way of example, with respect to a series of embodiments of furniture systems in accordance with the invention, as described herein and illustrated in FIGS. 1-29. Furniture systems in accordance with the invention have the capability of converting from what is characterized as a "sofa" configuration to a "bed" or "sleep surface" configuration. One set of concepts in accordance with the invention relate to linkage mechanisms utilized to convert the furniture systems between the configurations. The concepts associated with linkage mechanisms will primarily be described with respect to a first embodiment of a furniture system in accordance with the invention, referred to herein as the furniture system 100. The furniture system 100 is primarily described with respect to FIGS. 1-14. Other embodiments of furniture systems in accordance with certain concepts of the invention are subsequently described herein with respect to FIGS. 15-29. It should emphasized that each of these further embodiments illustrated in FIGS. 15-29 can incorporate linkage mechanisms corresponding to those which will be described herein with respect to furniture system 100 and FIGS. 1-14.

Figure 1:
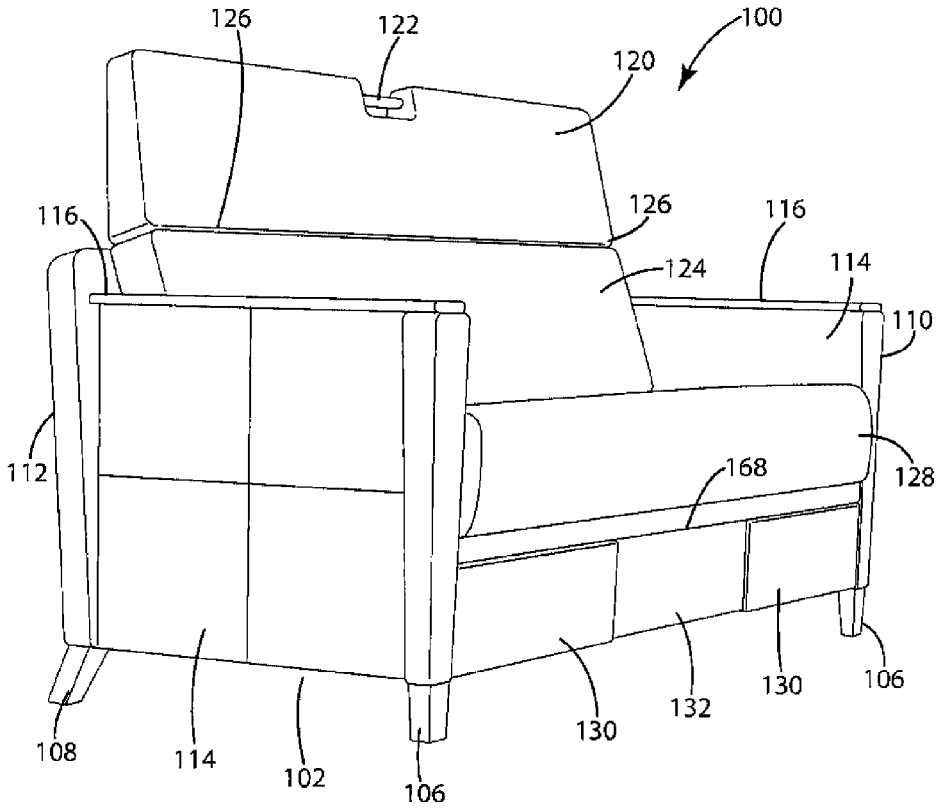
FIG. 1 is a left-side perspective view of a first embodiment of a furniture system in accordance with the invention, with the furniture system illustrated in a sofa configuration, and having one or more retracted ottomans and a retracted drawer.
Figure 2:
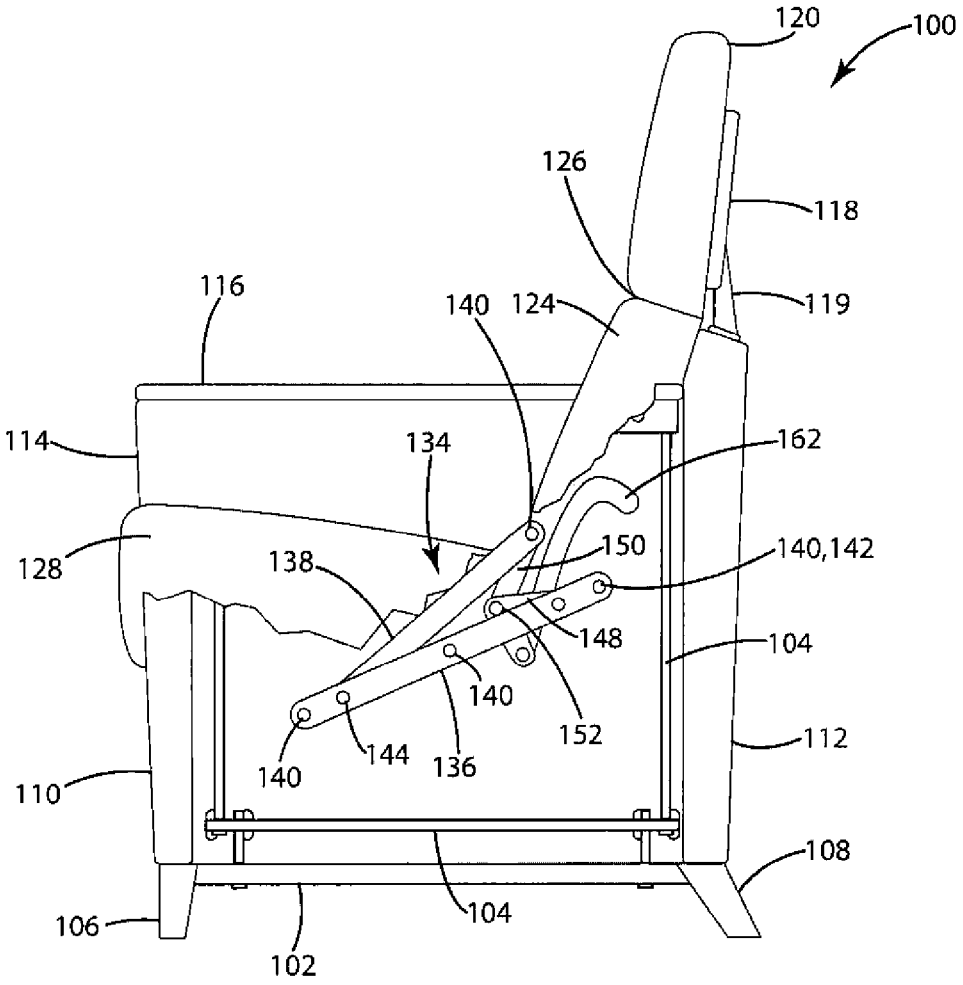
FIG. 2 is a right-side elevation view of the first embodiment of the furniture system shown in FIG. 1, and showing a portion of the right-side of the furniture system cut away so as to illustrate one of the sleep system linkage mechanisms used with the furniture system in accordance with the invention.
Figure 3:
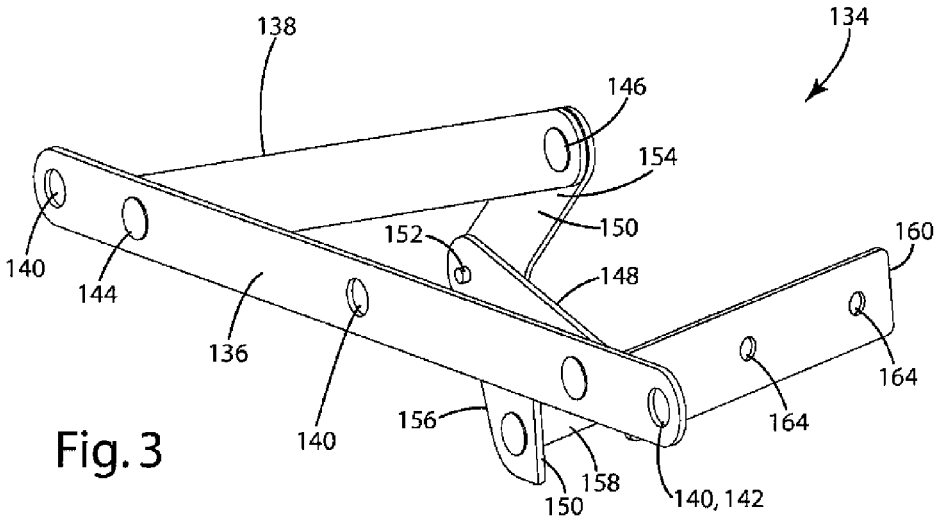
FIG. 3 is a forward, perspective view of the sleep system linkage mechanism illustrated in FIG. 2.
Figure 4:
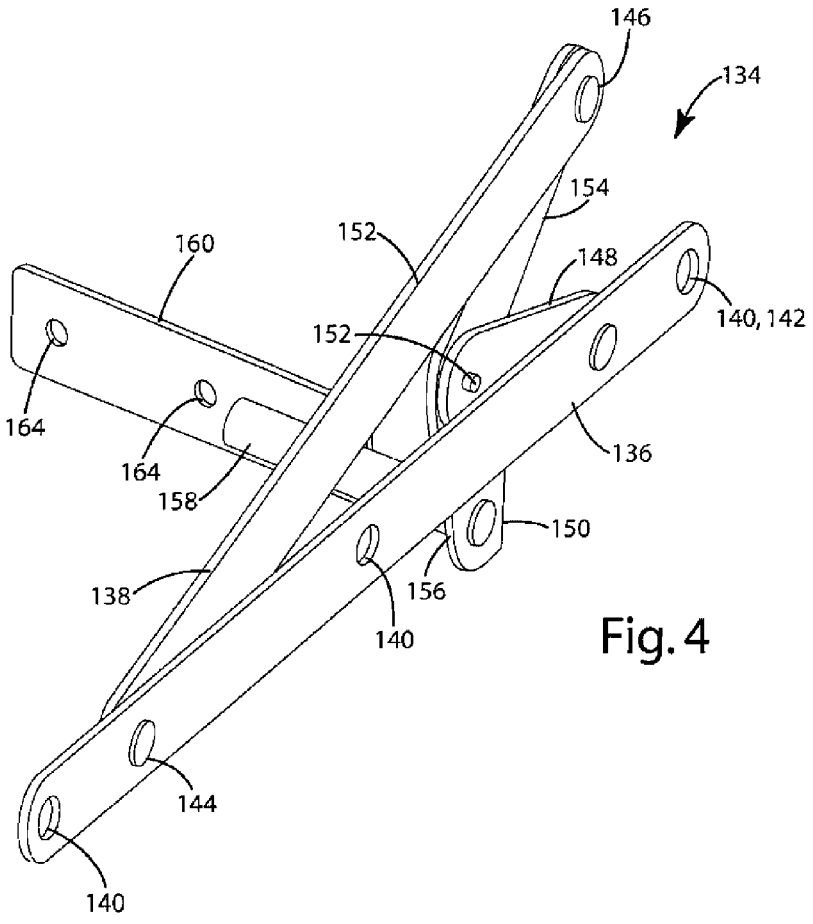
FIG. 4 is a perspective view of the linkage mechanism shown in FIG. 3, rotated 90 degrees in a horizontal plane relative to FIG. 3.
Figure 5:
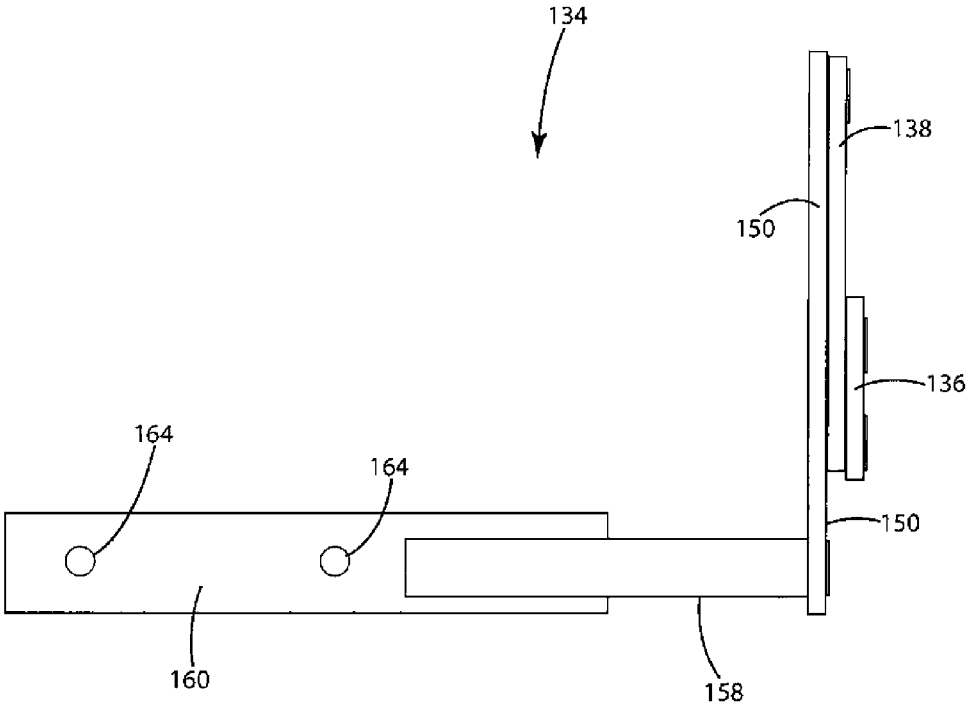
FIG. 5 is a front, elevation view of the linkage mechanism shown in FIG. 4.
Figure 6:
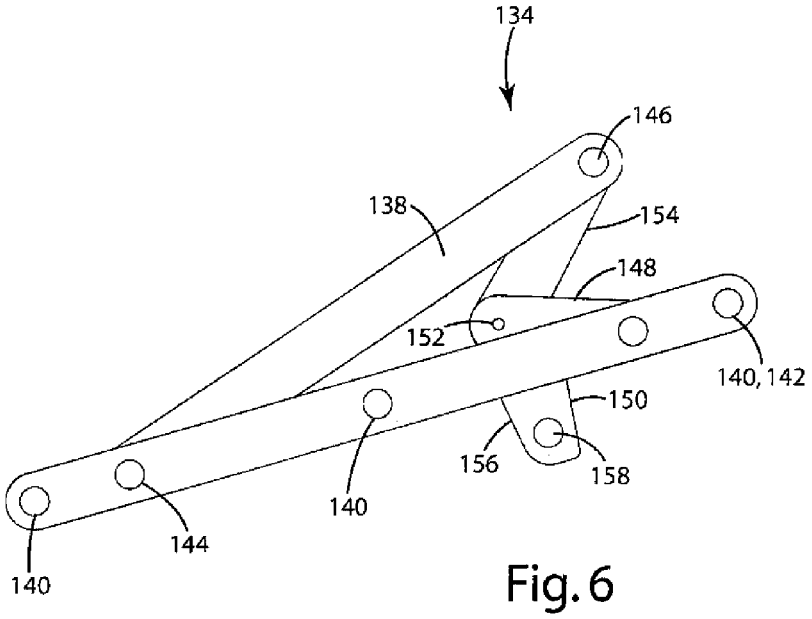
FIG. 6 is a side, elevation view of the linkage mechanism shown in FIG. 5, and illustrating the mechanism in a configuration corresponding to the furniture system being in a sofa configuration.
Figure 7:
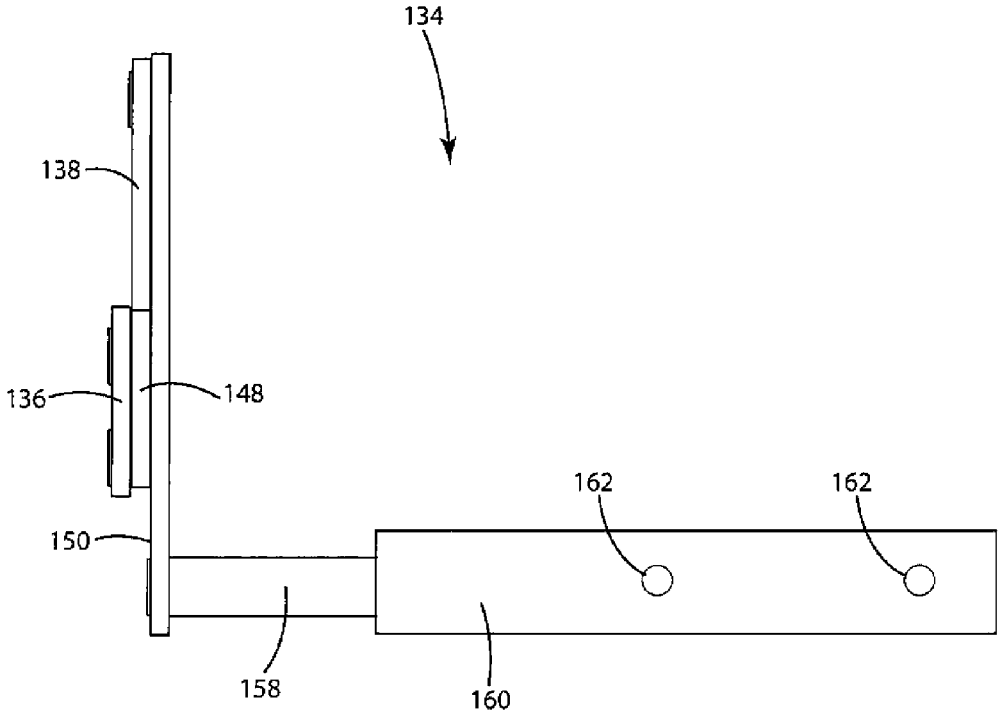
FIG. 7 is a rear, elevation view of the linkage mechanism shown in FIG. 6.
Figure 8:
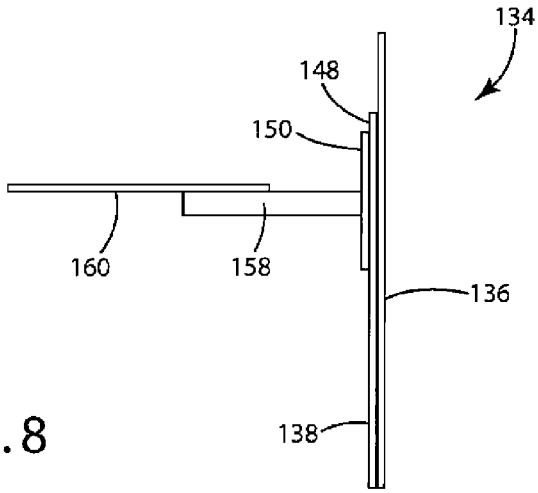
FIG. 8 is a view which can be characterized as a plan view of the linkage mechanism shown in FIG. 7.

Turning first to FIGS. 1 and 2, FIG. 1 illustrates the furniture system 100 in a left-side perspective view. In FIG. 1, the system 100 is shown in the "sofa" configuration. Correspondingly, FIG. 2 is a side, elevation and partially "cut away" view of the furniture system 100 shown in FIG. 1, again with the system in a sofa configuration. As shown in these illustrations, the furniture system 100 can include a lower base 102 having any of a number of various configurations. The lower base 102 is connected to other structural components through a connecting frame 104. The base 102 and connecting frame 104 can be structured in any of a number of various configurations. Integral with or otherwise secured to the lower base 102 are a series of front legs 106 and rear legs 108 (only one of the rear legs 108 being shown in FIGS. 1 and 2). Upstanding adjacent the front legs 106 are a pair of front corners 110. Located at the rear of the furniture system 100 and extending upwardly from the rear legs 108 is a stationary furniture back 112. Secured to the front of the stationary furniture back 112 adjacent the lateral edges thereof are a pair of sides 114. The sides 114 extend forwardly and can include corresponding arms or armrests 116 positioned on the top of the sides 114.

For purposes of strength and support, the furniture system 100 can also include a stationary high back support 118 extending upwardly from the stationary furniture back 112. The stationary high back support 118 can be positioned above the stationary furniture back 112 and secured through the use of a pair of support mounts 119. The overall shape and structural configuration of the stationary high back support 118, support mounts 119, and stationary furniture back 112 are best illustrated in drawings which show furniture system embodiments in a sleep or bed configuration, such as FIG. 16.

As further shown in FIGS. 1 and 2, the furniture system 100 also includes a movable high back cushion 120. The movable high back cushion 120, with the system 100 in a sofa configuration, can rest against the stationary high back support 118 as expressly shown in FIG. 2. The movable high back cushion 120 can include a handle 122 accessible to the user. As described subsequently herein, a user can be positioned in the front of the furniture system 100 and can pull forwardly on the handle 122 so as to initiate movement of the system 100 from a sofa configuration to a sleep or bed configuration. Coupled to the movable high back cushion 120 at the lower portion thereof is an intermediate back cushion 124. As shown in the drawings, the intermediate back cushion 124 can be somewhat angled relative to vertical when the system 100 is in the sofa configuration. Coupling between the movable back cushion 120 and the intermediate back cushion 124 can be provided through the use of a fabric hinge 126. The fabric hinge 126 can be configured so as to secure together the back cushion 120 and back cushion 124, while allowing some relative movement there between when the furniture system 100 is moved from the sofa configuration to the sleep or bed configuration. In addition to the foregoing components, the furniture system 100 also includes a seat cushion 128, shown in both FIGS. 1 and 2. As will be apparent from further description herein, the seat cushion 128 remains stationary during conversion movement of the furniture system 100 between the sofa configuration and the bed or sleep surface configuration.

In addition to the foregoing components of the furniture system 100, the system 100 and other embodiments in accordance with the invention can include one or a pair of extendable and retractable integrated ottomans 130. The ottomans 130 are shown in a retracted configuration in FIG. 1, and are positioned below the seat cushion 128 on opposing sides of the system 100. The ottomans 130 will be subsequently described herein, primarily with respect to FIGS. 25, 26 and 27. In addition to the ottomans 130, the furniture system 100 can also include an extendable and retractable drawer 132. As shown in FIG. 1, the drawer 132 can be located below the seat cushion 128 and intermediate the ottomans 130. FIG. 1 illustrates the drawer 132 in a retracted position.

In accordance with certain primary concepts of the invention, the furniture system 100 includes a pair of linkage mechanisms 134. FIG. 2 illustrates one of the linkage mechanisms 130. The structure and functional operator of the linkage mechanisms 134 will be described in subsequent paragraphs herein with respect to FIGS. 2-14. The drawings illustrate only one of the linkage mechanisms 134, and the subsequent description herein will primarily be directed only to a single linkage mechanism 134. However, both of the linkage mechanisms 134 will operate in tandem and are structurally and functionally equivalent.

In accordance with certain concepts of the invention, each of the linkage mechanisms 134 is configured and packaged so as to exist within the interiors of each of the sides 114 below the arms 116. Positioning the linkage mechanisms 134 in these "hidden" interiors essentially eliminates a safety hazard which exists with respect to other linkage systems which may have physically accessible "pinch points" and other structures of potential harm.

Turning to the details of the example embodiment of the linkage mechanisms 134 in accordance with the invention, reference is first made to FIGS. 2-10. FIG. 2, as earlier described, illustrates one of the linkage mechanisms 134 as coupled to the furniture system 100 and secured within one of the sides 114. FIGS. 3-10 illustrate the linkage mechanism 134 in a "stand alone" configuration, with each of the illustrations showing the linkage mechanism 134 in various orientations. In each orientation, the linkage mechanism 134 is illustrated in the configuration shown in FIG. 2, which corresponds to the furniture system 100 being in a sofa configuration. The linkage mechanism 134 includes a mechanism base plate 136 having an elongated configuration as illustrated in each of FIGS. 2-10. The mechanism base plate 136 essentially remains stationary during functional operation of the linkage mechanism 134 as the furniture system 100 moves between the sofa position and the sleep or bed position. The mechanism base plate 136 is fixedly secured to the inner portion of a corresponding side 114 at frame connection points 140. As shown initially in FIG. 2, the mechanism base plate 136 includes three frame connections points 140. The connection points are essentially located at the ends of the base plate 136 and one connection point 140 is located adjacent the center area of base plate 136. For purposes of having the base plate 136 "stand away" from the side 114, the base plate 136 can be secured to the furniture system side 114 at the frame connection points 140 through a series of three plastic spacer bushings having flat head bolts (and associated T-nuts) inserted therethrough. As an example of sizing, the plastic spacer bushings can be 0.80 inches thick, with the bolts each being 5/16 inches in size. In addition to the foregoing, the plastic spacer bushing which is associated with the frame connection point 140 located at one end of the base plate 136 is identified not only with a numerical reference 140, but with numerical reference 142. The plastic spacer associated with this particular connection points 140, 142 will function as a stop for a secondary mechanism lever 148 (shown in FIG. 14) when the furniture system 100 is moved to a sleep position. It should be noted that FIG. 2 is illustrating the system 100 in the sofa position.

In addition to the mechanism base plate 136, the linkage mechanism 134 also includes a primary mechanism lever 138 having an elongated configuration as also shown in FIGS. 2-10. Front and rear views of the primary mechanism lever 138 can best be seen in FIGS. 6 and 9. The primary mechanism lever 138 has an elongated configuration and is pivotably coupled to the mechanism base plate 136 at a mechanism hinge point 144. The primary mechanism lever 138 can be characterized as one of two moving levers which govern the path of the intermediate back cushion 124 during movement in converting between sofa and bed or sleep surface configurations. With the primary mechanism lever 138 pivotably coupled at one end to the mechanism base plate 136 at mechanism hinge point 144, the opposing terminating end includes a pivot connection referenced as the main hinge point 146. The primary mechanism lever 138 can be characterized as linking this main hinge point 146 to the sofa frame or side 114 through the mechanism base plate 136.

Figure 9:
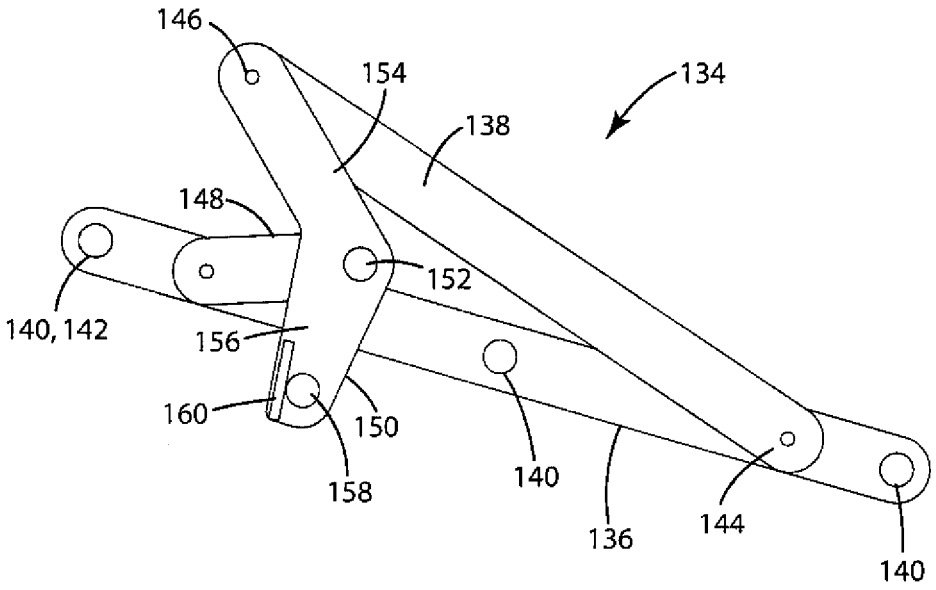
FIG. 9 is a side, elevation view of the linkage mechanism shown in FIG. 8, with the view directly opposing the side, elevation view of the linkage mechanism shown in FIG. 6.
Figure 10:
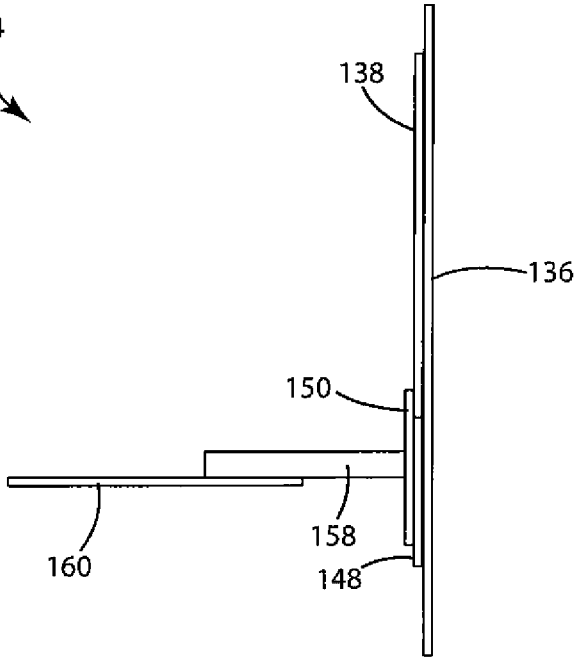
FIG. 10 is an underside view of the linkage mechanism shown in FIG. 9.

The linkage mechanism 134 further includes a secondary mechanism lever 148, again primarily shown in FIGS. 2-10. The secondary mechanism lever 148, as described subsequently herein, controls the rotational arc of the back cushions 120, 124 as they move between sofa and bed configurations. The secondary mechanism lever 148 is connected to the primary mechanism lever 138 at the main hinge point 146 through what is characterized as a mechanism control link 150. The mechanism control link 150 can be characterized as being locked into position relative to the back cushion 124. That is, the relative orientations of the link 150 and back cushion 124 remain the same during movement. The secondary mechanism lever 148 is hinged to the mechanism control link 150 at the hinge point 152 illustrated in the drawings. The mechanism control link 150 is particularly shown in its entirety in FIG. 9, and includes a first section 154 and an integral second section 156 which is angled relative to the first section as shown in FIG. 9. Also shown in FIG. 9 is the hinge point 152. The hinge point 152 is the pivotal connection between the mechanism control link 150 and the secondary mechanism lever 148. As further shown primarily in FIGS. 3-10, the linkage mechanism 134 also includes a mechanism drive shaft 158. The mechanism drive shaft 158 has a cylindrical and elongated configuration. One end of the mechanism drive shaft 158 is secured to one end of the second angled section 156 of the mechanism control link 150. The drive shaft 158 can be press fitted or otherwise secured to the mechanism control link 150 in any suitable manner. As further shown in a number of the drawings, including FIG. 3, a mechanism connection plate 160 is fixedly secured to an outer surface of the mechanism drive shaft 158. The mechanism connection plate 160 can be rectangular in configuration, with its elongated dimension running axially along the outer surface of the mechanism drive shaft 158. The connection plate 160 can be secured to the drive shaft 158 by any suitable means, including weldments and the like.

With reference back to FIG. 2, the inner portion of the side 114 shown therein includes a cut out portion in the form of a curvilinear clearance slot 162. The clearance slot 162 acts so as to provide for what could be characterized as minimum clearance for other components so as to avoid the occurrence of any pinch points associated with the sleep mechanism. To provide for a connection between moving components of the linkage mechanism 134 and the bed cushions 120, 124 of the furniture system 100, the connection plate 160 can be appropriately secured to these components of the system 100. As shown for example in FIG. 3, apertures 164 are formed through the connection plate 160 so as to provide the capability of securing the connection plate 160 to other components of the furniture system 100 through screws or other suitable connecting means. For example, the connection plate 160 can be secured through the use of 5/16 inch buttonhead bolts, with corresponding T-nuts.

Figure 11:
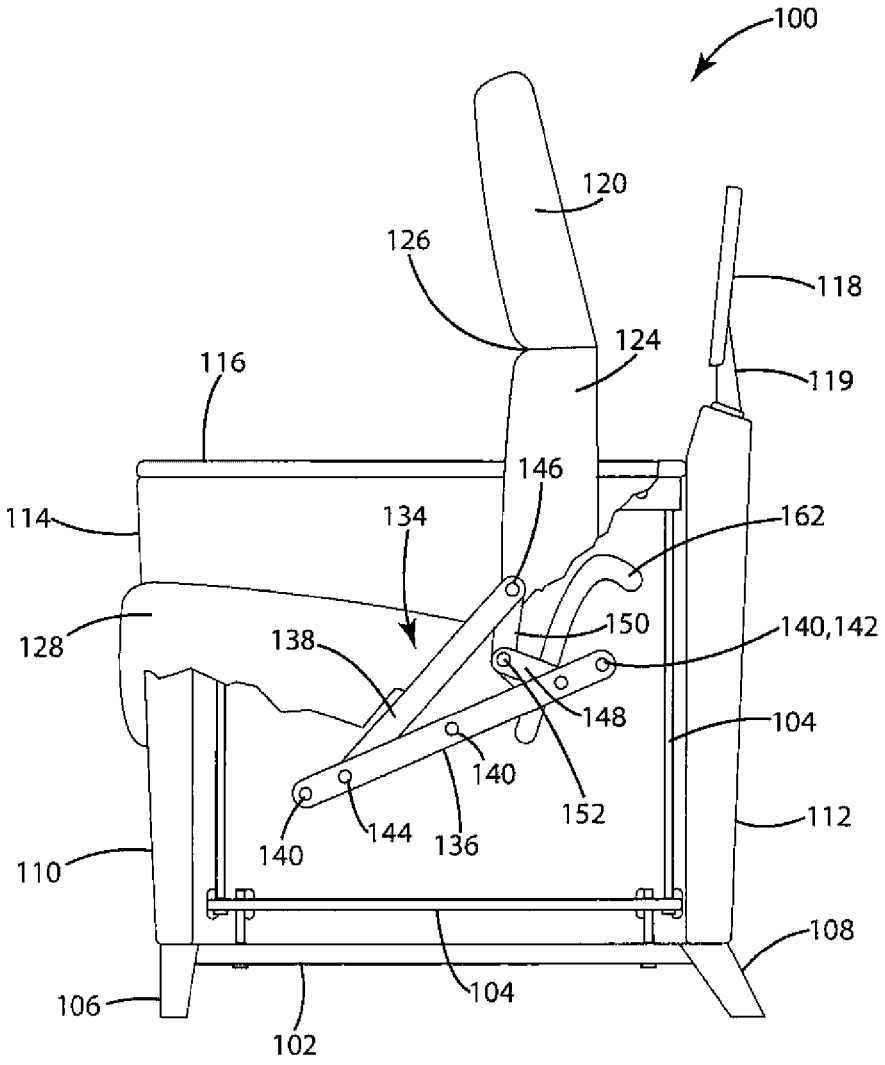
FIG. 11 is a side, elevation view of the furniture system shown in FIG. 2, with one of the linkage mechanisms shown within a cutout configuration, with the illustration similar to FIG. 2 but showing the furniture system and linkage mechanism in an "intermediate" position as the furniture system is moved between the sofa configuration and the bed or sleep surface configuration.
Figure 12:
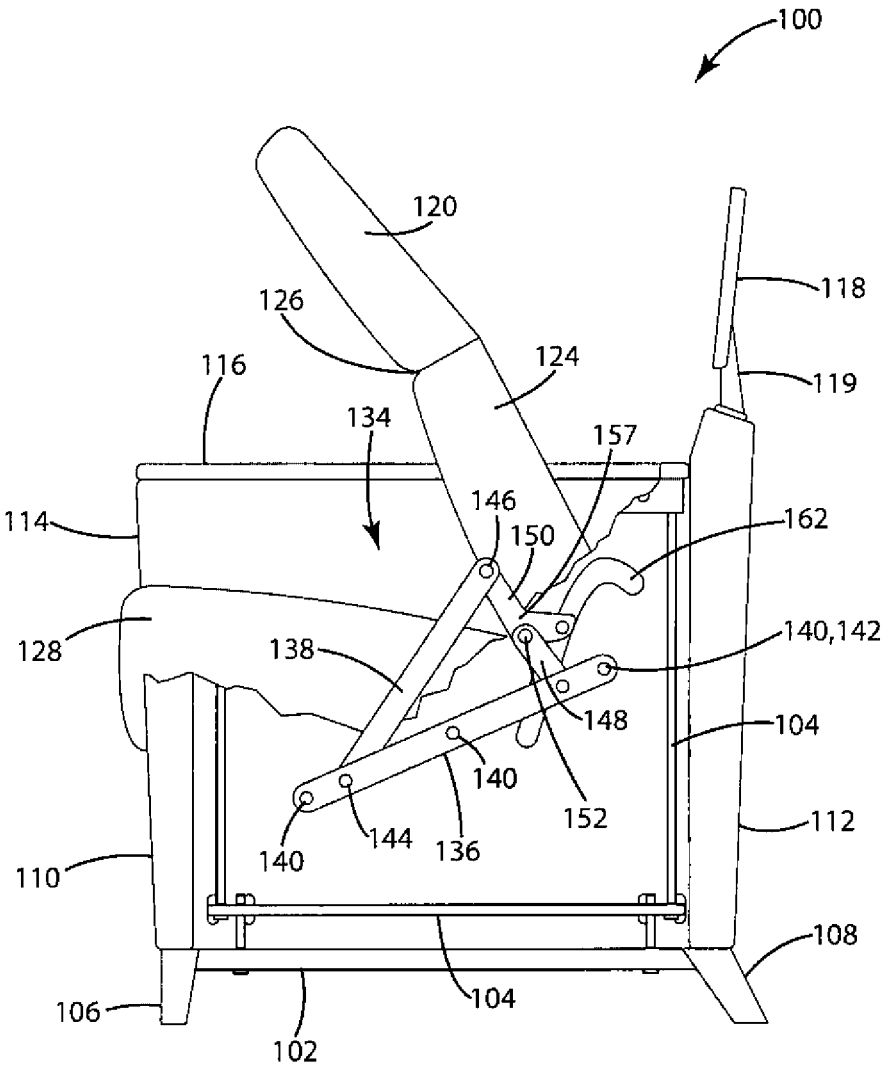
FIG. 12 is a side, elevation view of the furniture system shown in FIGS. 2 and 11, with one of the linkage mechanisms shown in a cutout configuration, and showing the furniture system, relative to FIG. 11, in a further transient position as the system is converted from the sofa configuration to the bed or sleep surface configuration.
Figure 13:
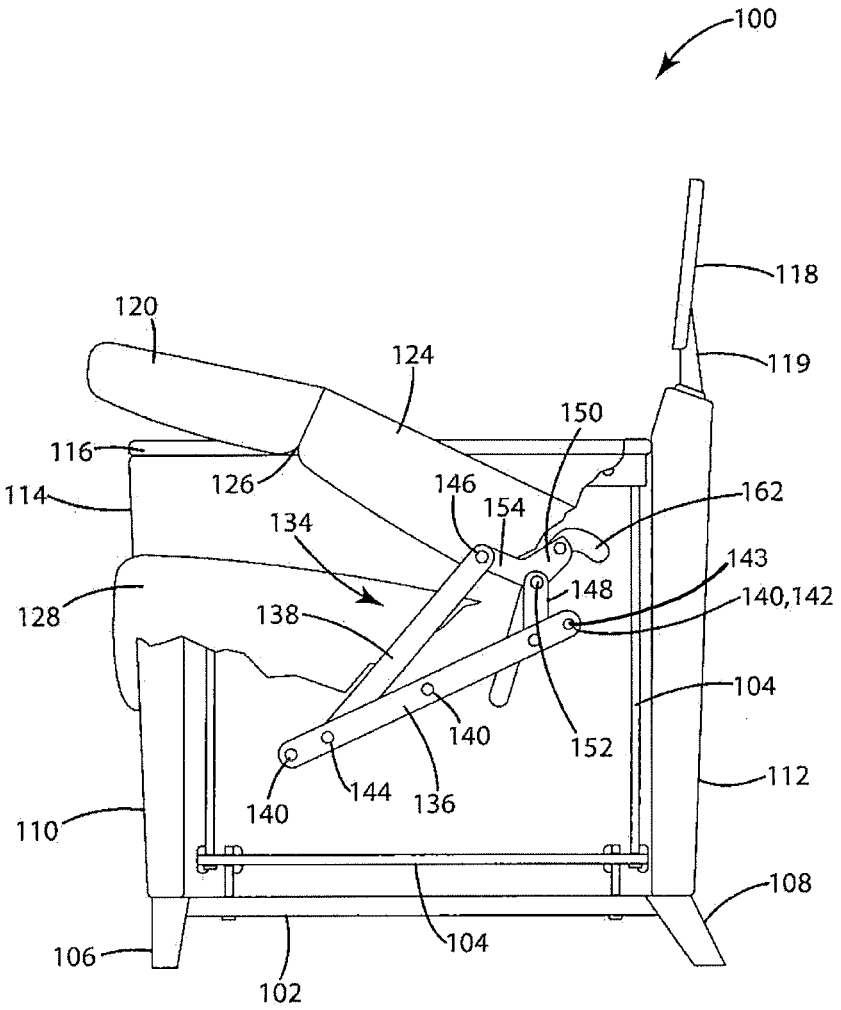
FIG. 13 is a side, elevation view of the furniture system shown in FIG. 12, and showing the system in further movement toward a bed or sleep surface configuration, with the back cushions moving further rearwardly.

Operation of the furniture system 100 with the linkage mechanisms 134 will now be described primarily with respect to FIGS. 2 and 11-14. FIG. 2, as previously described, illustrates the furniture system 100 in a sofa configuration. In this configuration, the user can pull forward on the top of high movable back cushion 120 through the handle 122 (the handle 122 is illustrated in FIG. 1). With the primary mechanism lever 138 linking the main hinge point 146 to the frame of the furniture system 100, the pulling forces exerted on the high movable bed cushion 120 will cause the main hinge point 146 to move upwardly and forwardly. This movement is particularly shown in FIGS. 11, 12 and 13. As specifically shown therein, this movement of the main hinge point 146 upwardly and forwardly permits the back cushions 120, 124 to also move upwardly and rotate forwardly in a manner so as to "clear" the seat cushion 128. Further, with this rotational arc of the back cushions 120, 124, the intermediate back cushion 124 is permitted to clear the seat cushion 128 without interfering with the stationary furniture back 112. FIGS. 12 and 13, in particular, show the back cushion 124 clearing the seat cushion 128, with corresponding clearance of the stationary furniture back 112. More specifically, the secondary mechanism lever 148, as earlier mentioned, controls the rotational arc of the back cushion 124. As illustrated in part in FIG. 2, with the furniture system 100 in the sofa configuration, the secondary mechanism lever 148 is in a substantially horizontal plane. During movement as illustrated in FIGS. 11, 12 and 13, the rotational arc of the secondary mechanism lever 148 and the back cushion 124 is initially upward. This upward movement provides for the requisite lift so as to clear the seat cushion 128.

As rotation of the back cushion 124 continues, the cushion will reach a position as particularly shown in FIG. 13. Further rotation will thereafter cause the back cushion 124 to essentially move rearwardly, with the primary mechanism lever 138 correspondingly moving downwardly. This movement will continue until the elongated primary mechanism lever 138 contacts the mechanism stop 143. With appropriate sizing and structural configuration of the various components of the linkage mechanisms 134, stoppage of the movement of the primary mechanism lever 138 will occur when the back cushions 120, 124 are essentially in a substantially planar configuration, as particularly shown in FIG. 14. This configuration corresponds to the bed or sleep surface configuration for the furniture system 100.

Figure 14:
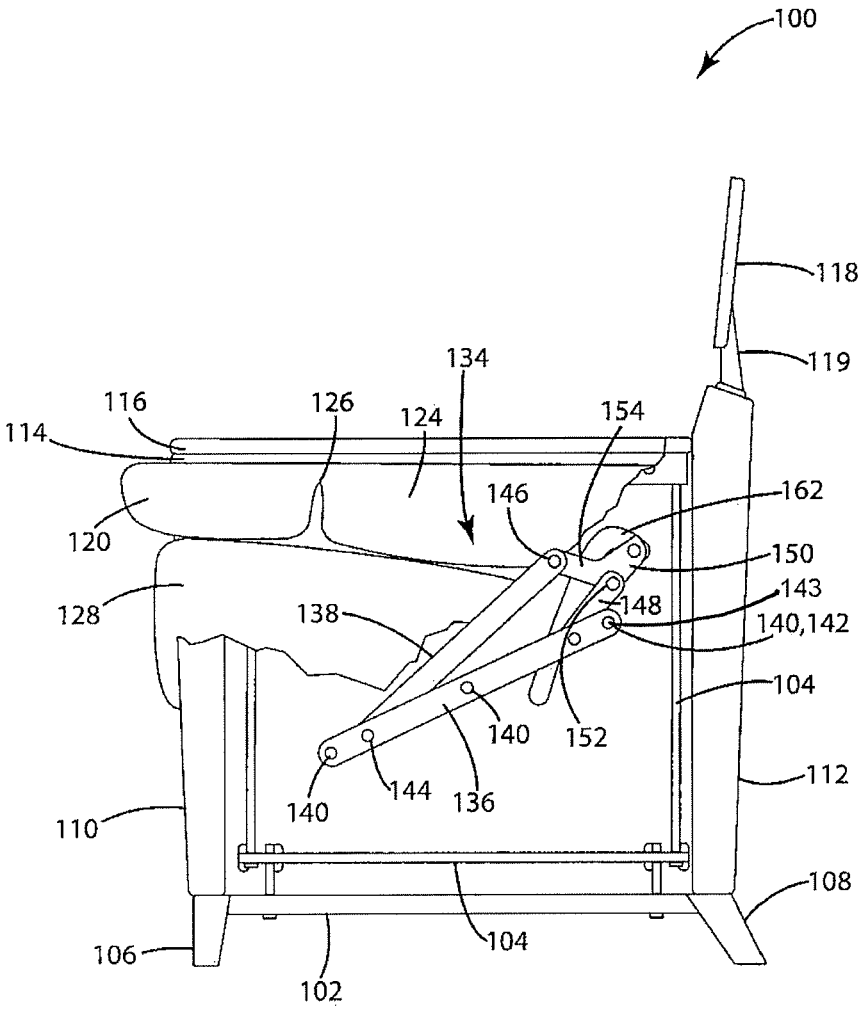
FIG. 14 is a side, elevation view of the furniture system shown in FIG. 13, and showing the furniture system in a final bed or sleep surface configuration, and further showing the position of the primary mechanism lever as it contacts a stop.

In this configuration, various concepts of the invention should be noted. More specifically, the high movable back cushion 120 provides not only seating comfort when in the sofa configuration, but also provides a relatively large sleep surface when in the sleep or bed configuration. This occurs in substantial part because the particular motion of the system mechanism allows the lower "hidden" portion of the back to be pulled out from behind the seat cushion, and to therefore be utilized as part of a sleep surface. Also, in this bed or sleep configuration as shown in FIG. 14, the fabric hinge 126 has allowed a gap or a spacing 166 to be formed between the high movable back cushion 120 and the intermediate back cushion 124. This capability of exhibiting this spacing 166 provided by the fabric hinge 126 permits the back of the high movable back cushion 120 and the back of the intermediate back cushion 124 to locate in the same, level horizontal plane. The fabric hinge 126 allows this horizontal plane configuration to be achieved, while also allowing a somewhat angular orientation to exist between the cushions 120, 124 when the furniture system 100 is in the sofa position as shown in FIG. 2. In general, the fabric hinge 126 permits articulation of the back cushions 120, 124. Further, the interface between the height and angle of the seat cushion, and the front sides of the two back cushions, also plays a role in achieving the advantageous horizontal, planar sleep surface.

Further, when the furniture system is in the bed or sleep position as shown in FIG. 14, the secondary mechanism lever 148 can essentially be characterized as being oriented beyond center. With this configuration, the secondary mechanism lever 148 will essentially support the sleep surface formed by the back cushions 120, 124, with the back cushion 124 located in part within the area which overhangs the seat cushion 128. That is, downwardly directed forces exerted on the back cushion 124 within this area which overhangs the seat cushion 128 will essentially be translated to the mechanism 142 through the primary mechanism lever 138 and the coupling to the secondary mechanism lever 148. Movement will essentially be stopped when the secondary mechanism lever 148 abuts the spacer associated with the frame connection point 142 (characterized as a mechanism stop 143), which essentially acts as a third attachment for the mechanism base plate 136.

Also in accordance with advantageous aspects of the furniture system 100 in accordance with the invention, and as earlier mentioned, the linkage mechanisms 134 can be confined within the sides 114 of the system 100. Accordingly, there is an aesthetically favorable "clean" look to the sides of the system 100, with no linkage mechanisms 134 being visible. Also, and of particular importance, the linkage mechanisms 134 do not exhibit any physically accessible or visual pinch points which can present a safety hazard. In this regard, the clearance slot 162 is hidden from view by the back and sufficient distance is provided between the slot 162 and the mechanism drive shaft 158 and mechanism connection plate 160 so as to avoid any pinch points which may be associated therewith. Further, with the linkage mechanisms 134, movement between sofa and sleep configurations is highly controlled, relatively error-proof, and requires only a "simple" path of motion. It should be emphasized that the reference to the "simple" or "single" path of motion refers to the required motion of the user. That is, to operate the furniture system 100, the user does not have to exert forces in multiple directions, take multiple stances or otherwise require any complex body movements. In this regard, the operational activities required by the user are essentially of minimal effort and can also be characterized as being "intuitive" for activities associated with converting an apparatus between a sofa position and a bed position.

Another advantage associated with certain concepts of the invention relates to the spatial areas existing between various components of the furniture system 100. With the system 100 as described herein, areas which can be characterized as "cleanouts" are provided at interfaces between the seat cushion 128 and the intermediate back cushion 124. These cleanout spaces also exist between the movable back cushions 120, 124 and the stationary furniture back 112. The formation of these spatial areas provides for allotted space for dirt and the like to fall (or to be pushed through) directly to a floor surface below the furniture system 100. This is a feature which can be particularly advantageous in settings such as health care facilities and areas of public access.

It should be emphasized that various other furniture systems having different structural configurations than the furniture system 100 can be utilized with linkage mechanisms in accordance with the invention, without departing from the novel concepts of the invention. For example, furniture systems in accordance with the invention can utilize a number of different frames, back rest configurations and the like.

Also, as previously described with respect to the furniture system 100, furniture systems in accordance with aspects of the invention separate from the linkage mechanisms 134 can be incorporated within furniture systems which could be adapted to utilize linkage mechanisms. As previously described, the system 100 is shown in FIG. 1 with a pair of extendable and retractable ottomans 130 positioned on opposing sides of the front of the lower portion of the furniture system 100. The ottomans 130 are shown in FIG. 1 in a retracted position. In addition, a drawer can also be incorporated within the furniture system 100, such as the extendable and retractable drawer 132 positioned intermediate the ottomans 130. In FIG. 1, the drawer 132 is also shown in a retracted position. The drawer 132 includes a handle 168 for purposes of extending and retracting the drawer 132. For purposes of operating the ottomans 130, so as to move the same between its extended and retracted positions, manually operable actuator levers 170 can be located on the outer surfaces of the opposing sides 114 of the furniture system 100 (only one of these levers 170 being shown in FIG. 1). One of the levers 170 can be utilized to functionally operate the ottoman 130 closest to the lever 170. The mechanisms for linking levers such as levers 170 to extendable and retractable ottomans are relatively well known in the art. Any of a number of different connection mechanisms can be utilized to provide for the appropriate structure and functional operation. In this regard, it should be emphasized that certain concepts associated with furniture systems in accordance with the invention relate to the ability of combining the functions of convertible sleep/sofa apparatus, with one or more retractable ottomans.

Figure 15:
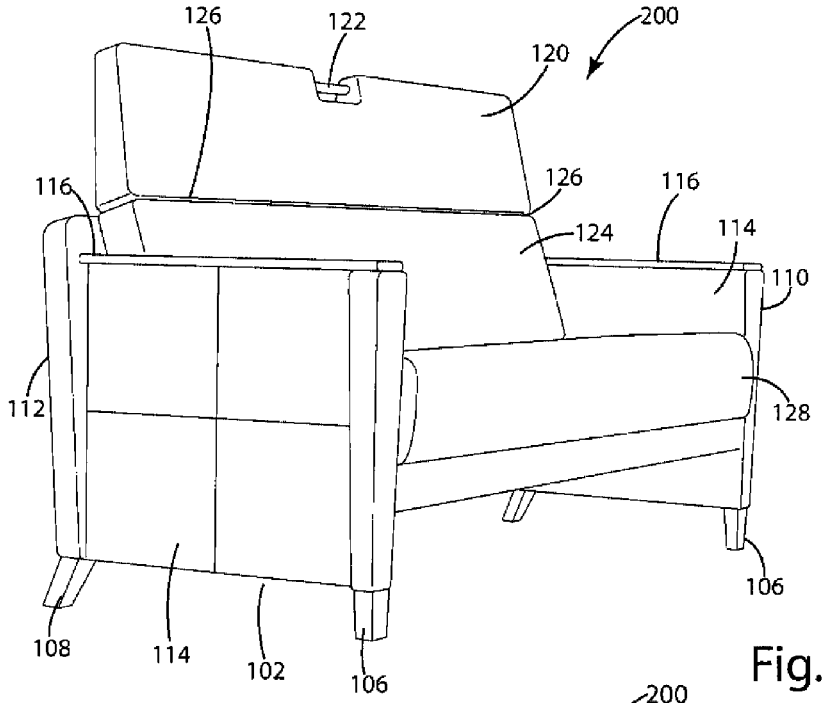
FIG. 15 is a left-side perspective view of a further embodiment of a furniture system in accordance with the invention, and showing the system in a sofa configuration, with recessed wood cap arms and an open base.
Figure 16:
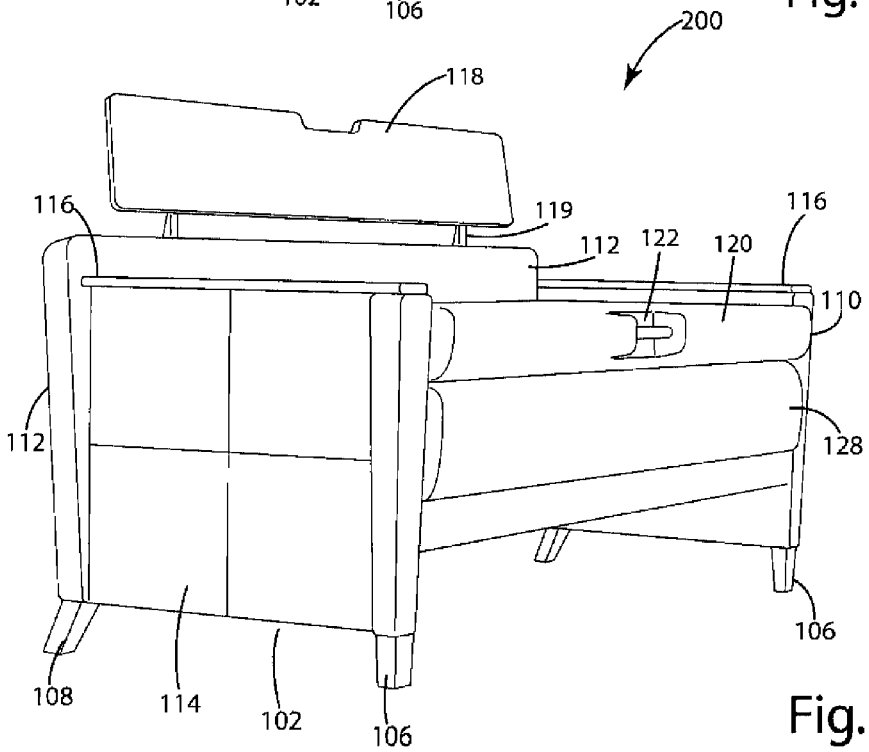
FIG. 16 is a left-side perspective view of the furniture system shown in FIG. 15, but showing the high back support and the furniture system in a sleep configuration.
Figure 17:
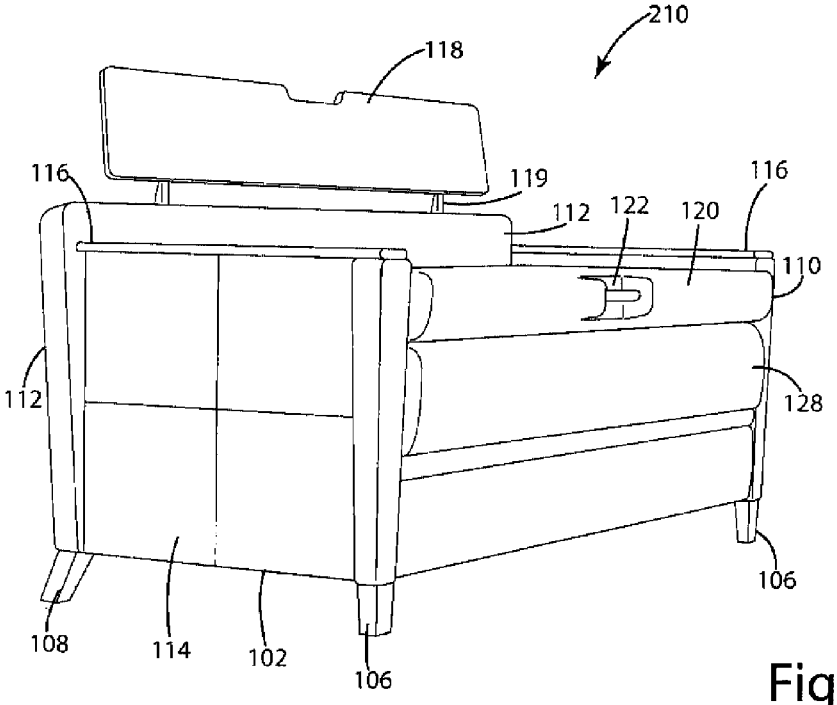
FIG. 17 is a left-side perspective view of a further embodiment of a furniture system in accordance with the invention, showing the system in a sleep position and having recessed wood cap arms with a continuous upholstered panel.
Figure 18:
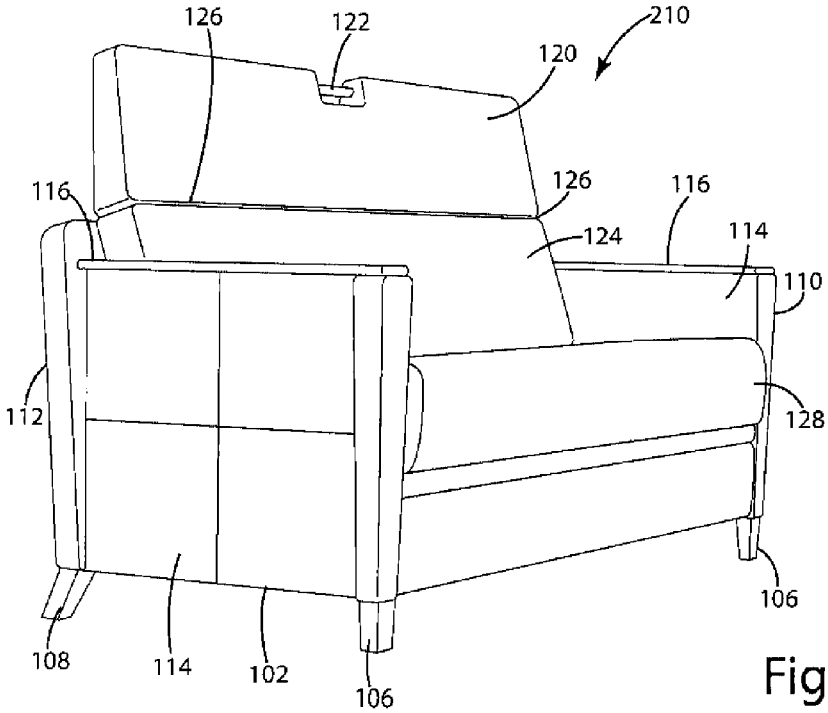
FIG. 18 is a left-side perspective view of the furniture system shown in FIG. 17, but showing the furniture system in a sofa position.
Figure 19:
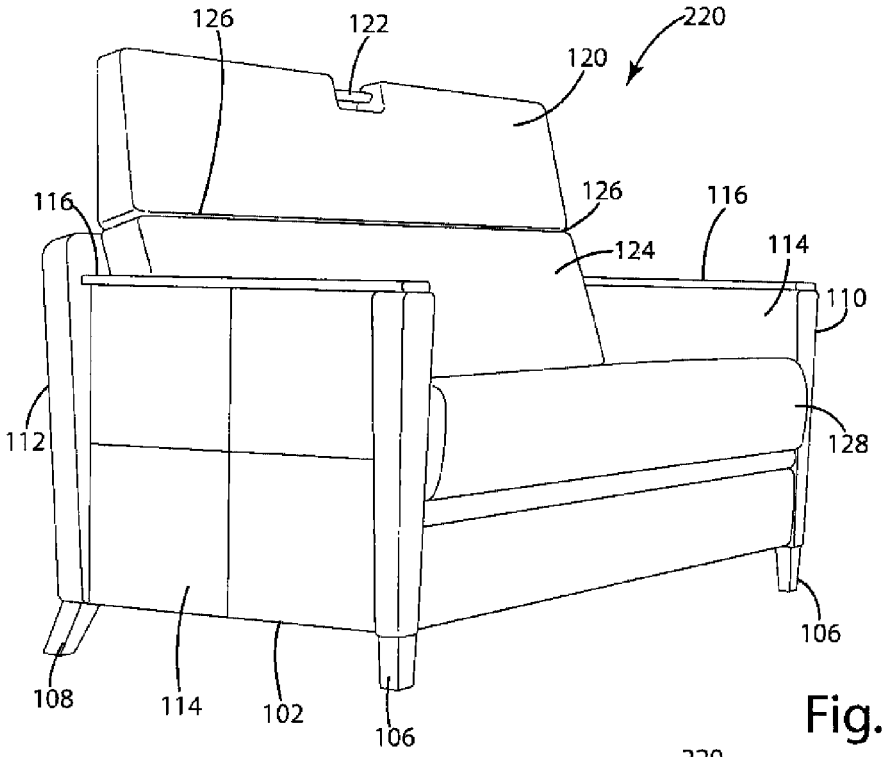
FIG. 19 is a left-side perspective view of a further embodiment of a furniture system in accordance with the invention, with the illustration showing the furniture system in a sofa position and having recessed wood insert/wood cap arms with a continuous upholstered panel.
Figure 20:
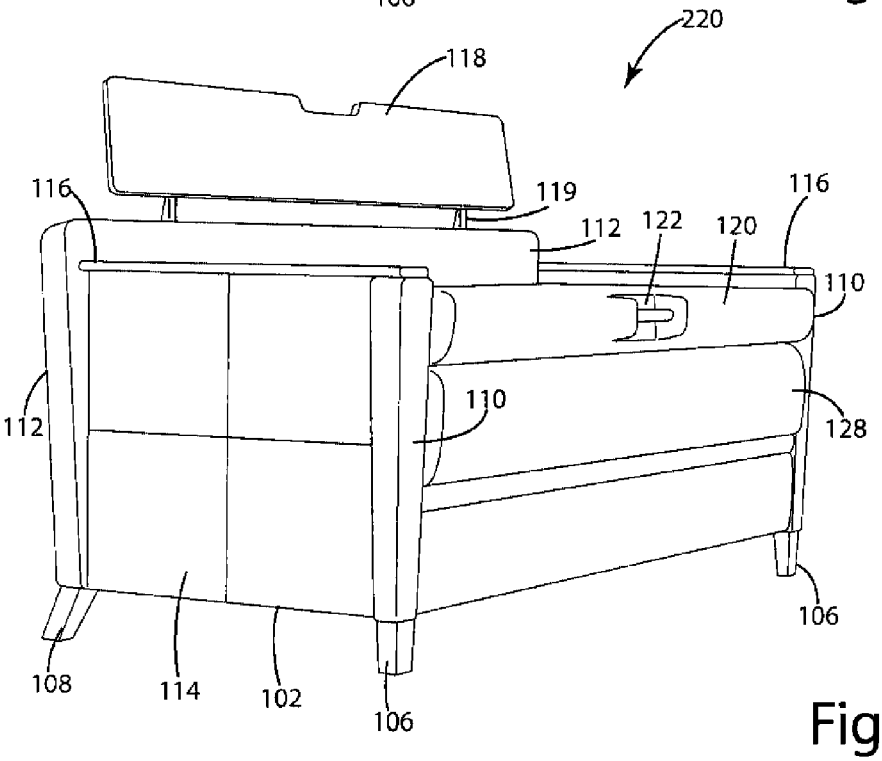
FIG. 20 is a left-side perspective view of the furniture system shown in FIG. 19, but showing the system in a sleep configuration.

Still further, the linkage mechanisms 134, ottomans 130 and drawer 132 can be utilized in a number of different embodiments of furniture systems in accordance with various aspects of the invention. For example, the sides 114 and arms 116 of the furniture system 100 shown in FIG. 1 can be characterized as having a recessed configuration with wood cap arms. Correspondingly, FIGS. 15-29 illustrate various other embodiments of furniture systems in accordance with the invention, showing the systems in both sofa and sleep configurations, and also showing various illustrations of the use of the ottomans 130 and drawer 132. For example, FIG. 15 illustrates a furniture system 200 in accordance with the invention. The furniture system 200 is shown in FIG. 15 in the sofa configuration. In this configuration, the sides 114 and arms 116 can be characterized as having a recessed configuration with wood cap arms. The system 200 can be characterized as an "open base" system, without ottomans or any drawer. FIG. 16 illustrates the furniture system 200 shown in FIG. 15, but showing the furniture system 200 in the sleep or bed configuration. FIG. 17 illustrates a further embodiment of a furniture system 210 in accordance with the invention. The system 210 is shown in the sleep configuration and includes sides 114 and arms 116 having recessed configurations with wood cap arms. The lower front of the system 210 includes a continuous upholstered panel. The system 210 does not include any ottomans 130 or drawer 132. FIG. 18 illustrates the furniture system 210 shown in FIG. 17, but with the system 210 in the sofa configuration. FIG. 19 identifies a further embodiment of a furniture system in accordance with the invention, characterized as furniture system 220. The furniture system 220 is shown in the sofa configuration in FIG. 19. The system 220 can be characterized as having sides 114 and arms 116 identified as recessed wood inserts with wood cap arms. The system 220 can also be characterized as one having a continuous upholstered panel. FIG. 20 is a further illustration of the system 220 shown in FIG. 19, but showing the system 220 in the sleep or bed configuration.

Figure 21:
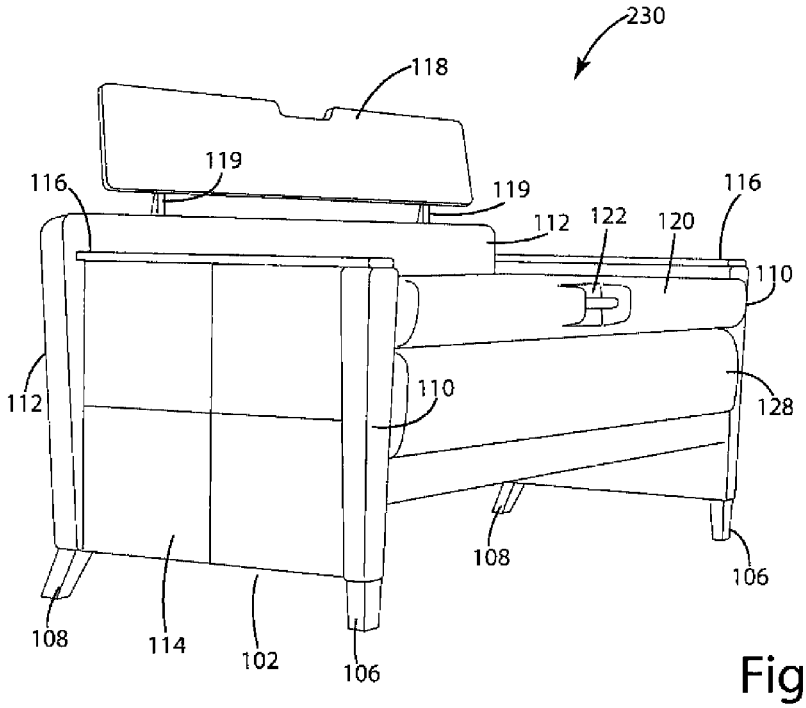
FIG. 21 is a left-side perspective view of a further embodiment of a furniture system in accordance with the invention, with the system shown in a sleep position and having recessed wood panel/wood cap arms with an open base.
Figure 22:
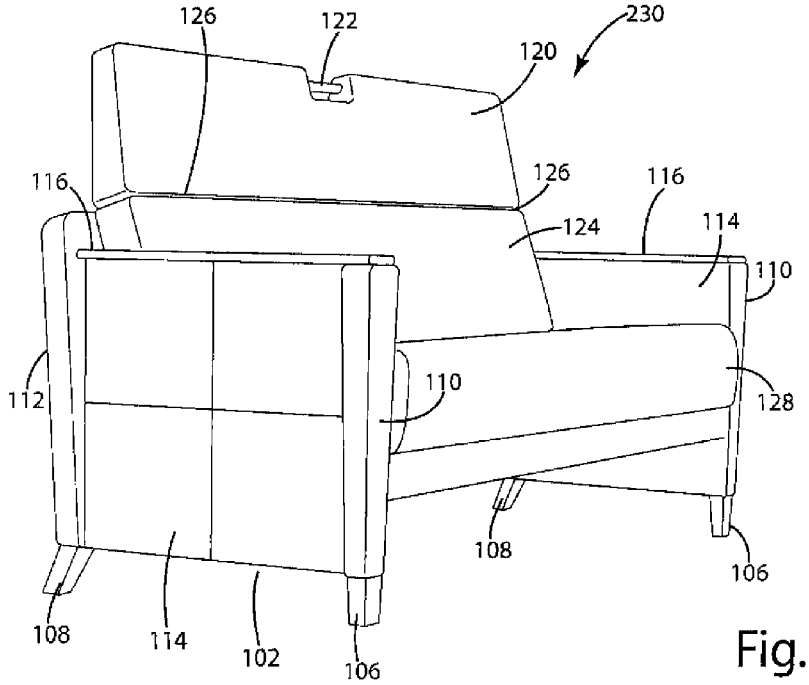
FIG. 22 is a left-side perspective view of a furniture system in accordance with FIG. 21, but showing the system in a sofa configuration.

FIG. 21 illustrates a further embodiment of a furniture system in accordance with the invention, referenced as furniture system 230. The sides 114 and arms 116 of the system 230 can be characterized as having a recessed wood panel configuration, with wood cap arms. The system 230 also includes an open base, without ottomans 130 or a drawer 132. FIG. 22 is a further illustration of the furniture system 230 as shown in FIG. 21, but showing the system 230 in the sofa configuration.

Figure 23:
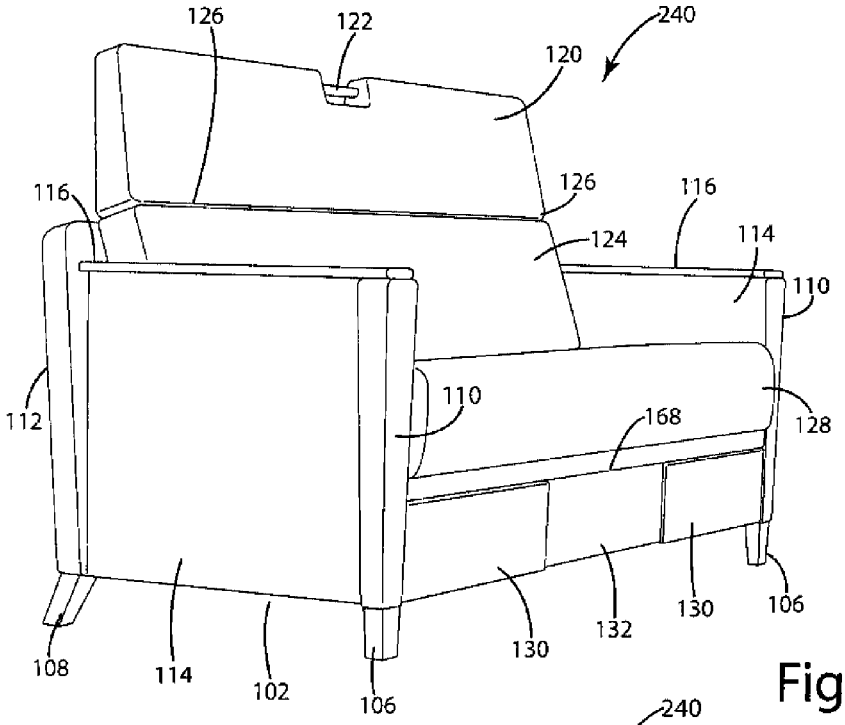
FIG. 23 is a left-side perspective view of a further embodiment of a furniture system in accordance with the invention, illustrating the furniture system in a sofa position and having recessed wood panel/wood cap arms with one or more retracted ottomans and a retracted drawer.
Figure 24:
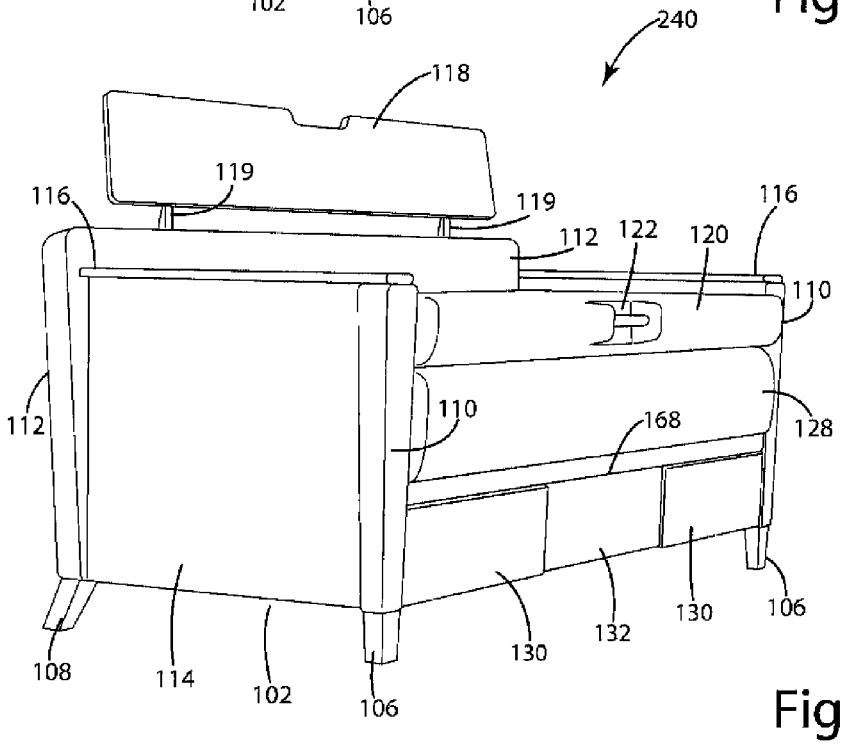
FIG. 24 is a left-side perspective view of the furniture system shown in FIG. 23, but showing the system in a sleep configuration.

FIG. 23 is an illustration somewhat similar to FIG. 1, but showing a furniture system 240. The system 240 includes sides 114 and arms 116 which can be characterized as having a recessed wood panel configuration, with wood cap arms. FIG. 23 also illustrates the ottoman and drawer options, and shows a pair of ottomans 130 and drawer 132 in retracted positions. FIG. 24 also illustrates the furniture system 240, but shows the furniture system 240 in the sleep or bed configuration.

Figure 25:
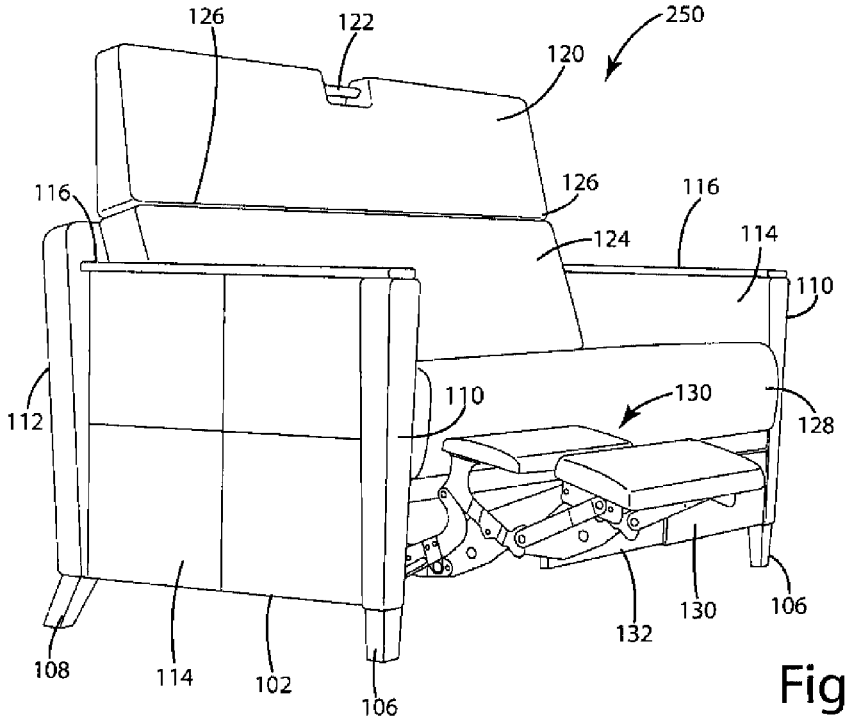
FIG. 25 is a left-side perspective view of a further embodiment of a furniture system in accordance with the invention, illustrating the system in a sofa configuration and having recessed wood cap arms, with a drawer in a retracted position and an ottoman in an extended position.
Figure 26:
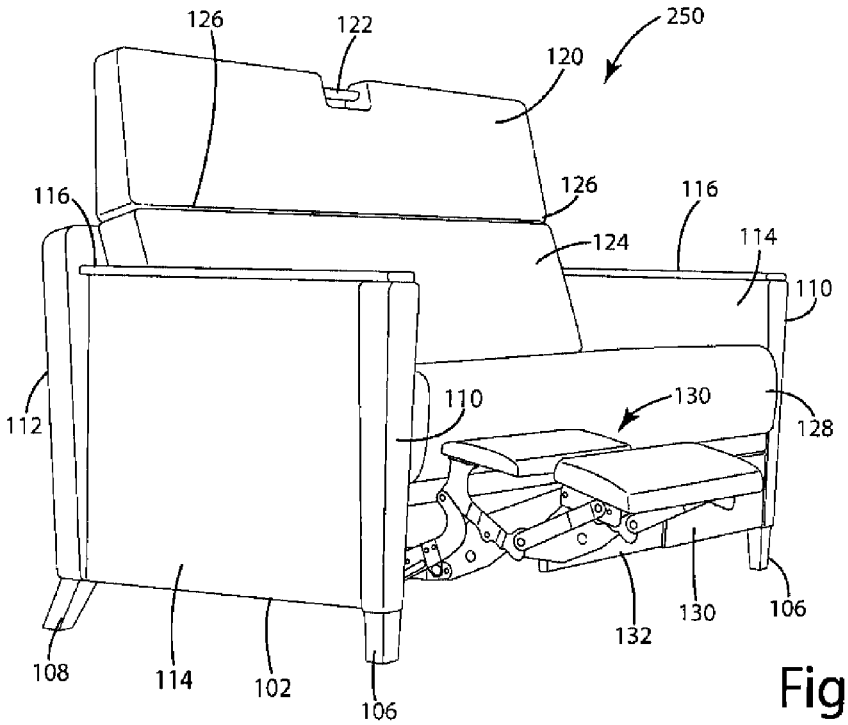
FIG. 26 is a left-side perspective view of the furniture system shown in FIG. 23, but showing an ottoman in an extended position.
Figure 27:
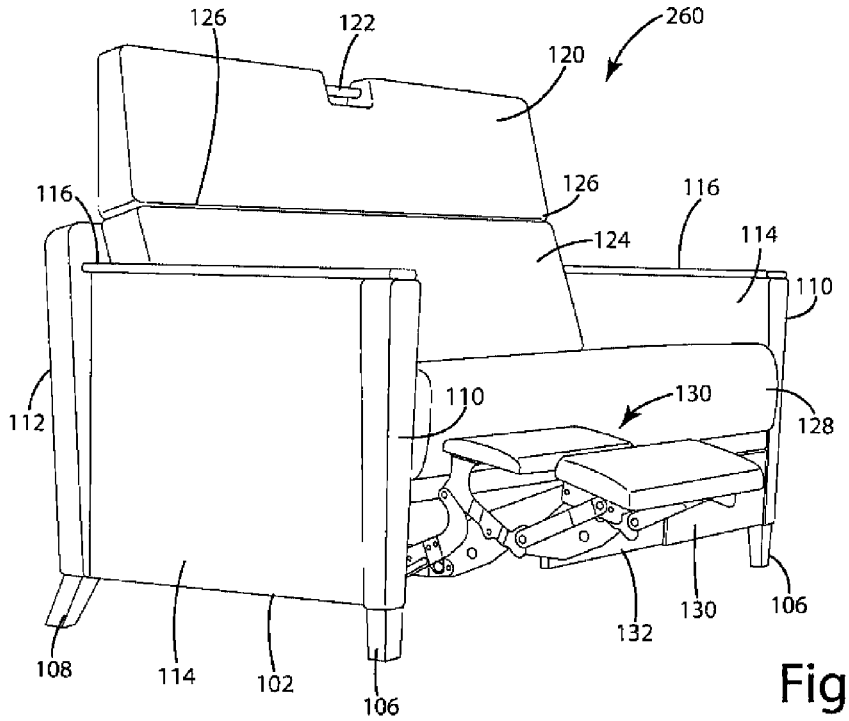
FIG. 27 is a left-side perspective view of a further embodiment of a furniture system in accordance with the invention, illustrating the furniture system in a sofa configuration and having upholstered arms with a retracted drawer and an extended ottoman.

FIG. 25 is an illustration of furniture system 242, showing a sofa with a recessed wood cap arm, having ottoman and drawer options. The ottoman 130 is shown in an extended position. FIG. 26 illustrates a furniture system 250 similar to the system shown in FIG. 24, with the system having a recessed wood panel with wood cap arms, and ottoman and drawer options with the ottoman 130 in an extended position. The sides 114 and arms 116 can be characterized as having recessed wood panels with wood cap arms. FIG. 27 illustrates a furniture system 260 in accordance with the invention, with the system being in the sofa configuration. The system is shown with an extended ottoman 130. The sides 114 and arms 116 of system 260 can be characterized as having upholstered configurations.

Figure 28:
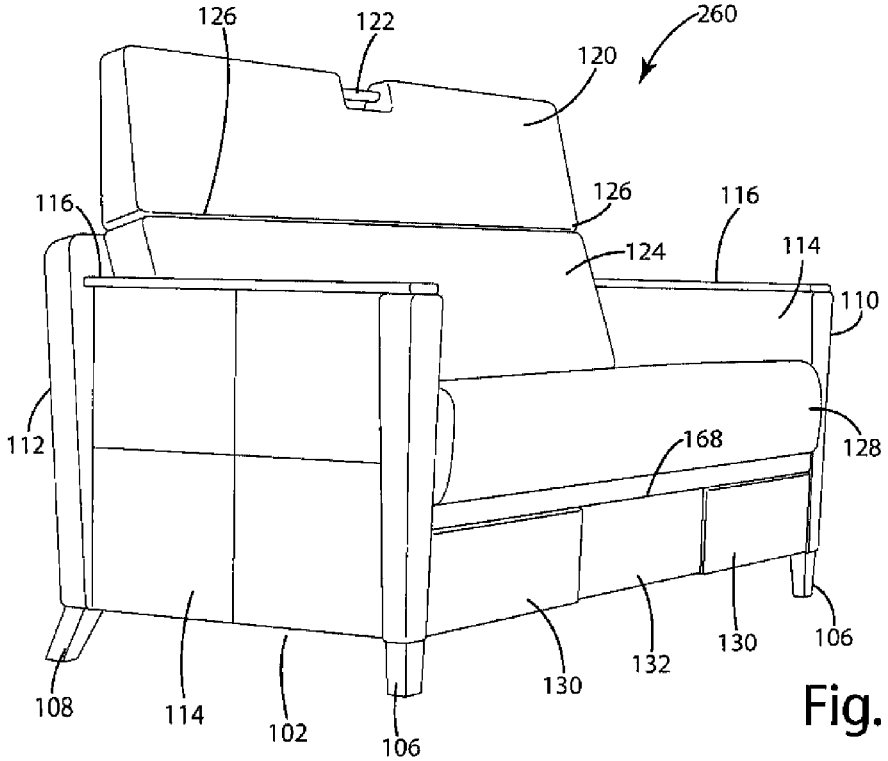
FIG. 28 is a left-side perspective view of the furniture system shown in FIG. 27, but with the ottoman in a retracted position.
Figure 29:
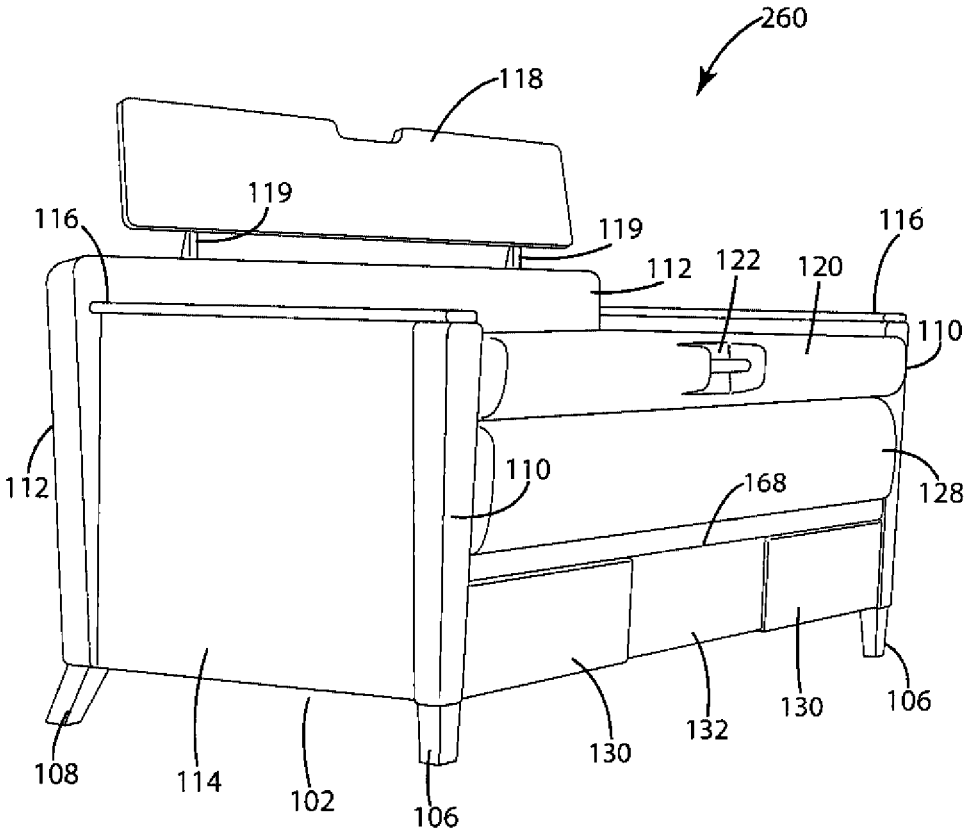
FIG. 29 is a left-side perspective view of the furniture system shown in FIG. 28, but showing the system in a sleep configuration.

FIG. 28 is a further view of the furniture system 260 in accordance with the invention. In contrast to FIG. 27, the furniture system 260 in FIG. 28 is shown with the ottomans 130 in retracted positions. FIG. 29 illustrates the furniture system 260 with the ottomans 130 in a retracted position, and with the system 260 in a sleep or bed configuration. As earlier stated, one of the principal concepts associated with the invention is the use of the sleep system embodiments described herein, in combination with the use of ottomans and drawers.

Figure 30:
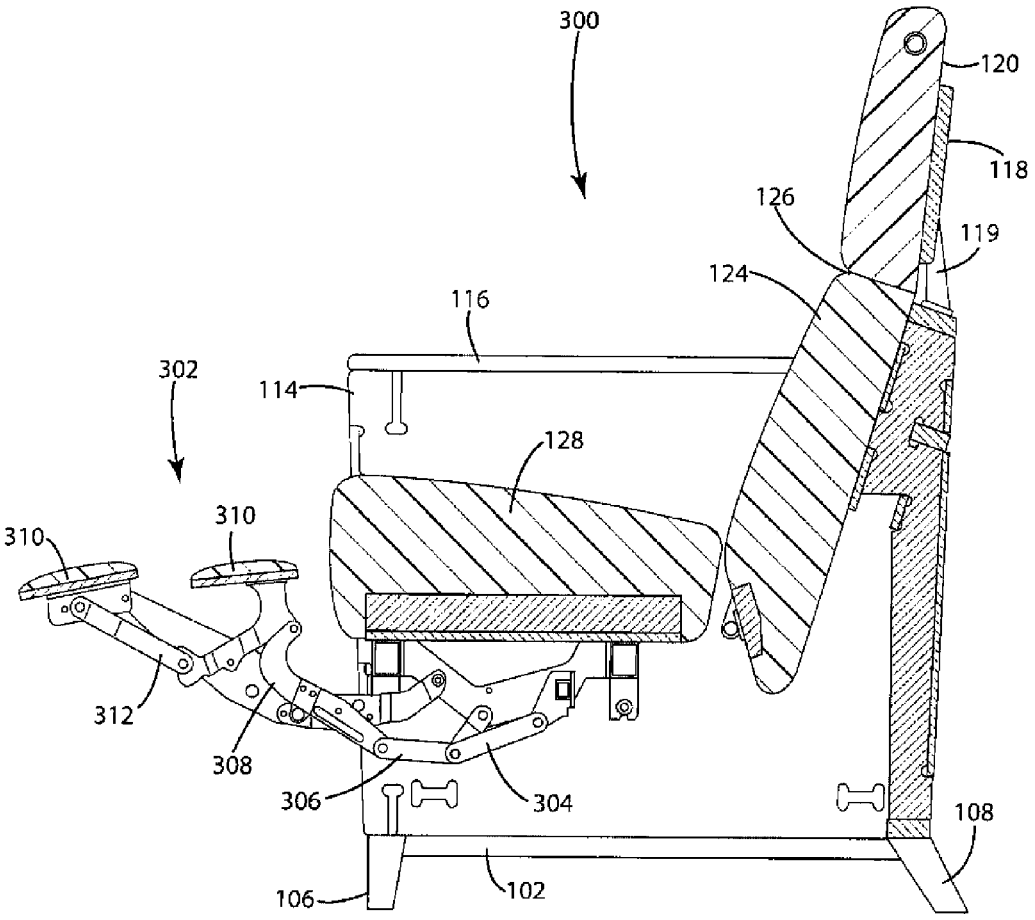
FIG. 30 is a side sectional view of an ottoman connected to a furniture system in accordance with the invention, and showing the ottoman in an extended position.

FIG. 30 illustrates a furniture system 300 in a vertical, sectional view, showing an example interconnection of an ottoman 302 to the furniture system 300, with the furniture system 300 having the convertible sofa/bed conversion mechanisms as previously described herein. It should be noted that FIG. 30 illustrates the ottoman 302 in an extended position. With reference to FIG. 30, the ottoman 302 is connected to appropriate elements of the sofa/bed configuration through a hardware assembly 304. The hardware assembly 304 includes a stationary support frame 306 fixedly secured to other elements of the sofa/bed configuration. It should be further emphasized that FIG. 30 is illustrating only one-half of the configuration of the ottoman 302 with the associated hardware assembly 304. Pivotably secured to a rear portion of the stationary support frame 306 is a pivot bracket 308. The pivot bracket 308, at an end opposing the connection to the stationary support frame 306, is coupled to a pivot link 310. The pivot link 310 is coupled both to the stationary support frame 306 and is associated with a second pivot bracket 312. The second pivot bracket 312 is coupled at one end in a pivotal matter to an external linkage 314. The external linkage 314 includes a first footpad link 316. The first footpad link 316 is coupled to a lower frame section of a first footpad 318. Coupled to the lower frame section of the first footpad 318 is a second footpad linkage 320. The second footpad linkage 320 is, in turn, coupled to the second footpad 322.

In accordance with the foregoing and as shown in FIG. 30, the hardware assembly 304 facilitates extension and retraction of the ottoman 302 in a relatively conventional manner. It should be emphasized that any of a number of commercially available ottomans can be utilized in accordance with the invention. For example, an ottoman having features associated with extension and retraction from seating furniture is disclosed in Johnson et al., U.S. Pat. No. 5,695,239, issued Dec. 9, 1997. In view of the foregoing, the specific mechanical structure of any given ottoman used in combination with a furniture system in accordance with the invention does not form any of the principal novel concepts of the invention.

It will be apparent to those skilled in the pertinent arts that other embodiments of sleep system mechanisms in accordance with the invention, including sleep systems with various ottoman combinations, can be designed. That is, the principles of sleep system mechanisms in accordance with the invention are not limited to the specific embodiments described herein. Accordingly, it will be apparent those skilled in the art that modifications and other variations of the above-described illustrative embodiments of the invention may be effected without departing from the spirit and scope of the novel concepts of the invention.

The invention claimed is:

1. A sleep system assembly adapted for conversion between a sofa configuration where a user may sit on said assembly in a substantially upright position, and a sleep configuration, where said user may lie in a substantially prone position, said assembly comprising:

a supporting frame;

a seat having an upper surface on which said user may sit when said assembly is in said sofa configuration;

a back cushion assembly having a frontal region for supporting said user's back when said assembly is in said sofa configuration;

at least one linkage mechanism, said linkage mechanism being directly or indirectly connected to said frame, and coupled to said back cushion assembly, said linkage mechanism guiding movement of said back cushion assembly between said sofa configuration and said sleep configuration in response to external forces applied by said user to said sleep system assembly;

when said sleep system assembly is in said sleep configuration, a sleep surface is formed by rear surface regions of said back cushion assembly, and said back cushion assembly is supported and prevented from further downward movement by elements of said sleep system assembly located only below said rear surface regions of said back cushion assembly; and said linkage mechanism is configured and coupled to said back cushion assembly so that movement of said sleep system assembly between said sofa configuration and said sleep configuration requires said user to only apply said external forces at a single location of said sleep system assembly.

2. A sleep system assembly in accordance with claim 1, characterized in that said linkage mechanism comprises:

a mechanism base plate connected to said frame;

a primary mechanism lever pivotably coupled to said base plate;

a secondary mechanism lever directly or indirectly coupled to said primary mechanism lever; and when said sleep system assembly is in said sleep configuration, support of said sleep surface is provided at least in part by said secondary mechanism lever being oriented beyond a center of equilibrium.

3. A sleep system assembly in accordance with claim 1, characterized in that said linkage mechanism comprises:

a mechanism base plate connected to said frame;

a primary mechanism lever pivotably coupled to said mechanism base plate;

a secondary mechanism lever directly or indirectly coupled to said primary mechanism lever; and downwardly directed forces, which are exerted on portions of said back cushion assembly which overhang said seat when said sleep system assembly is in said sleep configuration, are translated to a mechanism stop through said primary mechanism lever and coupled to said secondary mechanism lever.

4. A sleep system assembly in accordance with claim 1, characterized in that:

said frame comprises a pair of opposing lateral sides; and said linkage mechanism is confined within said lateral sides, so as to be physically inaccessible to said user, in the absence of disassembly of one or more of said sides.

5. A sleep system mechanism in accordance with claim 1, characterized in that said linkage mechanism is configured and connected to other components of said sleep system assembly so that when said user applies said external forces to said sleep system assembly so as to move said back cushion assembly between said sofa configuration and said sleep configuration, said user requires only a single, continuous path of motion by said user at said single location where said user is applying said external forces to said sleep system assembly.

6. A sleep system assembly in accordance with claim 1, characterized in that:

said frame comprises a pair of opposing lateral sides; and said lateral sides are structured so as to be capable of disassembly, so as to facilitate maintenance of said linkage mechanisms.

7. A sleep system assembly in accordance with claim 1, characterized in that said linkage mechanism comprises:

a mechanism base plate connected to said frame;

a primary mechanism lever coupled to said mechanism base plate; and a secondary mechanism lever, connected directly or indirectly to said primary mechanism lever.

8. A sleep system assembly in accordance with claim 7, characterized in that said primary mechanism lever and said secondary mechanism lever are configured so as to govern a path and rotational arc of said back cushion assembly during conversion of said sleep system assembly between said sofa configuration and said sleep configuration.

9. A sleep system assembly in accordance with claim 1, characterized in that:

said sleep system assembly further comprises a stationary back located behind said back cushion assembly when said sleep system assembly is in said sofa configuration; and said linkage mechanism provides for clearance of said back cushion assembly relative to said seat and to said stationary back, when said sleep system assembly is being moved by said user between said sofa configuration and said sleep configuration.

10. A sleep system assembly in accordance with claim 1, characterized in that none of said plurality of interconnected links are connected at any single point to more than one other of said interconnected links.

11. A sleep system assembly in accordance with claim 7, characterized in that said sleep system assembly further comprises a mechanism control link connecting said secondary mechanism lever to said primary mechanism lever.

12. A sleep system assembly in accordance with claim 11, characterized in that said linkage mechanism further comprises a mechanism drive shaft extending in a perpendicular orientation relative to a general vertical plane of said linkage mechanism, with one end of said mechanism drive shaft being secured to an angled section of said mechanism control link.

13. A sleep system assembly in accordance with claim 12, characterized in that said sleep system assembly further comprises a mechanism connection plate secured to an outer surface of said mechanism drive shaft, said mechanism connection plate providing connection between moving components of said linkage mechanism and said back cushion assembly.

14. A sleep system assembly in accordance with claim 11, characterized in that:

said back cushion assembly comprises an intermediate back cushion; and said mechanism control link is locked into position relative to said intermediate back cushion, so that a relative orientation of said mechanism control link and said intermediate back cushion remains substantially the same during movement of said intermediate back cushion between said sofa configuration and said sleep configuration.

15. A sleep system assembly in accordance with claim 11, characterized in that:

said secondary mechanism lever is pivotably linked to said mechanism control link at a first hinge point; and said mechanism control link comprises an angled configuration.

16. A sleep system assembly in accordance with claim 1, characterized in that said plurality of interconnected links comprises a mechanism base plate connected to said frame, said mechanism base plate remaining stationary during movement of said sleep system assembly between said sofa configuration and said sleep configuration.

17. A sleep system assembly in accordance with claim 16, characterized in that said mechanism base plate is connected to an inner portion of a corresponding side of said sleep system assembly.

18. A sleep system assembly in accordance with claim 17, characterized in that said connection of said mechanism base plate to said corresponding side of said sleep system assembly occurs at a plurality of frame connection points, one of said frame connection points also acting as a stop for a secondary mechanism lever, when said linkage mechanism moves said sleep system assembly from said sofa configuration to said sleep configuration.

19. A sleep system assembly in accordance with claim 1, characterized in that:

said linkage mechanism and other components of said sleep system assembly are structured so that when said sleep system assembly is being moved by said user from said sofa configuration to said sleep configuration, there is no forward movement of any components of said sleep system assembly, except for links of said plurality of interconnected links, and said back cushion assembly; and when said sleep system assembly is configured in said sleep configuration, the floor space footprint of said sleep system assembly is no larger in area than the floor space footprint of said sleep system assembly when said sleep system assembly is in said sofa configuration.

20. A sleep system assembly in accordance with claim 1, characterized in that said linkage mechanism further comprises:

a mechanism base plate connected to stationary components of said sleep system assembly;

a primary mechanism lever pivotably coupled at one end thereof to said mechanism base plate at a first hinge point;

a secondary mechanism lever, configured so that said primary mechanism lever and said secondary mechanism lever control a rotational arc of said back cushion assembly as said back cushion assembly moves between said sofa configuration and said sleep configuration;

a mechanism control link connecting said secondary mechanism lever to said primary mechanism lever, said primary mechanism lever being directly connected to said mechanism control link at a second hinge point; and said primary mechanism lever links said second hinge point to stationary components of said sleep system assembly through said mechanism base plate.

21. A sleep system assembly in accordance with claim 1, characterized in that said seat remains stationary during movement of said sleep system assembly between said sofa configuration and said sleep configuration.

22. A sleep system assembly in accordance with claim 1, characterized in that:

said frame comprises a pair of opposing sides having inner portions associated therewith; and said inner portions of said sides comprise cut-out portions in the form of curvilinear clearance slots, said clearance slots providing minimum clearance so as to prevent tampering, and also providing sufficient clearance for other components of said sleep system assembly so as to avoid the occurrence of any pinch points associated with said sleep system assembly.

23. A sleep system assembly in accordance with claim 1, characterized in that said back cushion assembly comprises:

an intermediate back cushion; and a high back cushion extending upwardly from a top portion of said intermediate back cushion, said high back cushion being configured so as to facilitate seated user comfort and extend said sleep surface, beyond the surface provided by the intermediate back cushion, when said sleep system assembly is in said sleep configuration.

24. A sleep system assembly in accordance with claim 23, characterized in that said assembly further comprises a high back stationary support, said high back stationary support being positioned behind and adjacent to said high back cushion when said sleep system assembly is in said sofa configuration, and with said high back stationary support remaining in a fixed position during movement of said sleep system assembly between said sofa configuration and said sleep configuration.

25. A sleep system assembly in accordance with claim 23, characterized in that said assembly further comprises a hinge located between a top of said intermediate back cushion and a lower portion of said high back cushion, said hinge being structured so as to permit articulation between said intermediate and said high back cushions, and further being structured so as to permit rear portions of said intermediate and said high back cushions to be positioned in substantially a single horizontal plane when said intermediate and said high back cushions are in said sleep configuration.

26. A sleep system assembly in accordance with claim 25, characterized in that said hinge comprises a fabric hinge, and a space formed around said fabric hinge widens as said sleep system assembly moves toward said sleep configuration.

27. A sleep system assembly in accordance with claim 1, characterized in that said sleep system assembly comprises a pair of linkage mechanisms, one of each of said pair of linkage mechanisms being associated with a corresponding one of a pair of opposing sides of said sleep system assembly.

28. A sleep system assembly in accordance with claim 1, characterized in that said assembly further comprises:

an ottoman assembly comprising one or more ottomans extending forwardly from front portions of said sleep system assembly.

29. A sleep system assembly in accordance with claim 28, characterized in that at least one of said ottomans is mechanically moveable by a user between an extended position where said ottoman is positioned forwardly of said front portions of said sleep system assembly, and a retracted position where said ottoman is positioned inwardly from said front portions and below said seat.

30. A sleep system assembly in accordance with claim 28, characterized in that said assembly further comprises at least one drawer assembly positioned below said seat and extendable by a user between an open, extended position and a closed, retracted position.

* * * * *